US007309554B2

(12) United States Patent
Miyakawa

(10) Patent No.: US 7,309,554 B2
(45) Date of Patent: Dec. 18, 2007

(54) NEGATIVELY CHARGEABLE TONER, METHOD FOR PRODUCING THE SAME, AND FULL COLOR IMAGE FORMING APPARATUS USING THE NEGATIVELY CHARGEABLE TONER

(75) Inventor: Nobuhiro Miyakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 323 days.

(21) Appl. No.: 10/892,826

(22) Filed: Jul. 15, 2004

(65) Prior Publication Data

US 2005/0058924 A1 Mar. 17, 2005

(30) Foreign Application Priority Data

Jul. 16, 2003 (JP) ..... 2003-197599

(51) Int. Cl.
*G03G 9/00* (2006.01)

(52) U.S. Cl. ..... 430/108.6; 430/108.7; 430/137.21; 430/137.1; 399/252

(58) Field of Classification Search ..... 430/108.6, 430/108.7, 137.21, 137.1; 399/252
See application file for complete search history.

(56) References Cited

U.S. PATENT DOCUMENTS

2003/0157419 A1* 8/2003 Miyakawa et al. ..... 430/108.6

FOREIGN PATENT DOCUMENTS

| | | |
|---|---|---|
| JP | 2000-181130 | 6/2000 |
| JP | 2001-300083 | 10/2001 |
| JP | 2002-029730 | 1/2002 |
| JP | 2002-148848 | 5/2002 |

* cited by examiner

*Primary Examiner*—Mark A. Chapman
(74) *Attorney, Agent, or Firm*—Hogan & Hartson LLP

(57) ABSTRACT

A negatively chargeable toner containing: resin particles containing a colorant; and an external additive which coats the surface of the resin particles, wherein the external additive contains; first silica particles having a number mean primary particle size of 5 to 20 nm and second silica particles having a number mean primary particle size of 30 to 50 nm; surface-modified silica particles which are surface modified by wet treatment using an oxide or hydroxide of at least one metal selected from the group consisting of titanium, tin, zirconium and aluminum, and are further subjected to hydrophobic treatment; and aluminum oxide-silicon dioxide composite oxide particles obtained by flame hydrolysis and hydrophobic treatment.

22 Claims, 4 Drawing Sheets

NEGATIVELY CHARGEABLE TONER, METHOD FOR PRODUCING THE SAME, AND FULL COLOR IMAGE FORMING APPARATUS USING THE NEGATIVELY CHARGEABLE TONER

FIELD OF THE INVENTION

The present invention relates to a negatively chargeable toner used for electrophotography, electrostatic printing and the like, a method for producing the same, and a image forming apparatus using the negatively chargeable toner.

BACKGROUND OF THE INVENTION

In electrophotography, an electrostatic latent image formed on a photoreceptor provided with a photoconductive material is developed with colorant-containing toner particles, and then, the resulting toner image is fixed onto a transfer material such as paper by heat, pressure or the like, thereby forming a copy or printed matter.

In order to improve physical properties of the toner, it is generally carried out to add an external additive (surface treating agent) to the toner particles. However, the toner particles have a size distribution, so that even when the external additive is added to the toner particles, there is a distribution in charging amount. Accordingly, even a negatively chargeable toner inevitably contains positively charged toner particles. In an image forming apparatus preparing an image by negative charge reversal development, there is the problem that the toner adheres to a non-image area of an image carrier (photoreceptor), the amount of the toner adhered to cause fogging further increases with an increase in the number of printed sheets, correlatively with deterioration of the toner, and the load of cleaning in the photoreceptor also increases. In particular, when the toner is used as a full color toner, a selective development occurs by a broadened charge distribution of the toner derived from the size distribution of the toner particles, or when positively charged toner particles exist, not only the problem of fogging but also the problem of the development of a "reverse transfer toner" reversely transferred to the photoreceptor in color superposition is encountered.

In a single-component non-magnetic toner, when a large amount of silica particles are added in order to prevent deterioration of the toner, the fluidity of the toner is secured, but the fixability is reduced. Further, in order to enhance the negatively chargeable capacity of the toner, it is known to add positively chargeable titania having a polarity opposite to that of the toner together with silica particles. However, positively chargeable titania is liberated from surfaces of the toner particles in some cases, with an increase in the number of printed sheets, which poses the problem with respect to the maintenance of image density in continuous printing. Further, when the negatively chargeable capacity of the toner becomes too high, the printed image density is reduced. To prevent this, it is also known to use titania having a relatively low electric resistance and a large primary particle size for preventing the titania particles from being embedded. However, an increase in the number of printed sheets raises the problem that titania is librated from surfaces of toner mother particles, resulting in failure to sufficiently exhibit the effects. Further, in order to prevent filming, it is also known to add aluminum oxide (alumina) particles together with silica particles. However, it is difficult to subject to hydrophobic treatment the alumina particles, and the introduction of excessive alumina particles raises the problem of shortening the life of a photoreceptor.

Further, when various metal oxide particles are externally added, it is known to adding particles having a relatively large particle size and particles having a relatively small particle size in combination, thereby improving the fluidity, cleaning property, transfer characteristics, charge property and "durability" (prolonging the life of the toner) of the toner. Furthermore, it is also known to specify the liberating rate of an external additive from toner mother particles, thereby making possible the charge stabilization, antifogging, white spot prevention, maintenance of image density and filming prevention. In addition, it is known that combined oxide particles comprising aluminum oxide and silicon dioxide are used as an external additive, thereby being able to obtain toner particles excellent in fluidity and showing stable charge behavior (reference 1). However, in any case, when the toner is applied to a full color toner, a selective development occurs by a broadened charge distribution of the toner derived from the size distribution of the toner particles, or the existence of positively charged toner particles poses not only the problem of fogging but also the problem of the development of a "reverse transfer toner" reversely transferred to the photoreceptor in color superposition.

Further, it is known to modify surfaces of single fine particles or parts thereof with another material, instead of using plural kinds of external additives in combination in toner particles, to obtain the effects of the plural kinds of external additives, such as the fluidity, charge property, maintenance of image density and fogging or filming prevention. For example, a toner for electrophotography is known in which hydrophobic fine particles obtained by coating fine silica particles with a hydroxide or an oxide of one or more of titanium, tin, zirconium and aluminum in an aqueous system, and further coating surfaces thereof with an alkoxysilane are used as an external additive (reference 2). Further, a toner is proposed in which silica-containing titanium oxide particles obtained by coating outer surfaces of silica particles with titanium oxide are used as an external additive (reference 3). According to the addition of such particles, it is possible to decrease the amount of positively charged toner particles, but the average charging amount is insufficient. Accordingly, neither of them achieves both objects of improving the transfer efficiency and reducing the reverse transfer toner.

[Reference 1]

JP-A-2000-181130 (the term "JP-A" as used herein means an "unexamined published Japanese patent application")

[Reference 2]

JP-A-2002-29730

[Reference 3]

JP-A-2002-148848

[Reference 4]

Japanese Patent No. 2533067

[Reference 5]

JP-A-2001-300083

The present invention relates to a negatively chargeable toner having a novel combination of external additives, which provides little fogging in a non-image area caused by a toner on a photoreceptor in development and can prevent excessive charge, resulting in improvement in the transfer efficiency and the prevention of the development of a reverse transfer toner on the photoreceptor in superposition of the second color or later, a method for producing the same, and a full color image forming apparatus using the negatively chargeable toner.

SUMMARY OF THE INVENTION

The present inventors have made eager investigation to examine the problem. As a result, it has been found that the foregoing objects can be achieved by the following negatively chargeable toner, the method of producing the same and the full color image forming apparatus using the negatively chargeable toner. With this finding, the present invention is accomplished.

The present invention is mainly directed to the following items:

1. A negatively chargeable toner comprising: resin particles comprising a colorant; and an external additive which coats the surface of the resin particles, wherein the external additive comprises; first silica particles having a number mean primary particle size of 5 to 20 nm and second silica particles having a number mean primary particle size of 30 to 50 nm; surface-modified silica particles which are surface modified by wet treatment using an oxide or hydroxide of at least one metal selected from the group consisting of titanium, tin, zirconium and aluminum, and are further subjected to hydrophobic treatment; and aluminum oxide-silicon dioxide composite oxide particles obtained by flame hydrolysis and hydrophobic treatment.

2. The negatively chargeable toner according to item 1, wherein the total amount of the first and second silica particles are 0.5 to 1.5% by weight based on the weight of the resin particles, wherein the weight ratio of the first silica particles to the second silica particles is from 5/1 to 1/5.

3. The negatively chargeable toner according to item 1, wherein the amount of the surface-modified silica particles is 0.005 to 0.5% by weight based on the weight of the resin particles, wherein the amount of the aluminum oxide-silicon dioxide composite oxide particles is 0.005 to 0.5% by weight based on the weight of the resin particles, wherein the total amount of the surface-modified silica particles and the aluminum oxide-silicon dioxide composite oxide particles is from 0.01 to 1% by weight based on the weight of the resin particles.

4. The negatively chargeable toner according to item 1, wherein the amount of the external additive is 0.51 to 2.5% by weight based on the weight of the resin particles.

5. The negatively chargeable toner according to item 1, which is produced through a polymerization method.

6. The negatively chargeable toner according to item 1, wherein the negatively chargeable toner has a sphericity of 0.94 or more.

7. The negatively chargeable toner according to item 1, wherein the negatively chargeable toner has a number mean particle size of 9 mm or less.

8. A full color toner comprising the negatively chargeable toner according to item 1.

9. A process for producing a negatively chargeable toner comprising the steps of: adding, to resin particles comprising a colorant, first silica particles having a number mean primary particle size of 5 to 20 nm and second silica particles having a number mean primary particle size of 30 to 50 nm; and further adding thereto surface-modified silica particles which are surface modified by wet treatment using an oxide or hydroxide of at least one metal selected from the group consisting of titanium, tin, zirconium and aluminum, and are further subjected to hydrophobic treatment, and aluminum oxide-silicon dioxide composite oxide particles obtained by flame hydrolysis and hydrophobic treatment.

10. A full color image forming apparatus comprising: a photoreceptor on which toner images are to be formed; an intermediate transfer medium for transferring the toner images formed on the photoreceptor to a recording medium; and a toner for forming the toner images comprising: a negatively chargeable toner comprising: resin particles comprising a colorant; and an external additive which coats the surface of the resin particles, wherein the external additive comprises; first silica particles having a number mean primary particle size of 5 to 20 nm and second silica particles having a number mean primary particle size of 30 to 50 nm; surface-modified silica particles which are surface modified by wet treatment using an oxide or hydroxide of at least one metal selected from the group consisting of titanium, tin, zirconium and aluminum, and are further subjected to hydrophobic treatment; and aluminum oxide-silicon dioxide composite oxide particles obtained by flame hydrolysis and hydrophobic treatment.

11. The full color image forming apparatus according to item 10, wherein the photoreceptor is a negatively chargeable organic photoreceptor.

12. The full color image forming apparatus according to item 10, wherein the intermediate transfer medium is a belt.

13. The full color image forming apparatus according to item 10, further comprising a image developing device, wherein the photoreceptor and the image developing device are integrated to form a process cartridge, wherein the process cartridge is detachably mounted on the image forming apparatus.

14. The full color image forming apparatus according to item 10, wherein the ratio of peripheral velocity of the photoreceptor to the intermediate transfer medium is from 0.95 to 1.05.

15. The negatively chargeable toner according to item 1, wherein the first and second silica particles are subjected to hydrophobic treatment.

16. The process for producing a negatively chargeable toner according to item 9, wherein the first and second silica particles are subjected to hydrophobic treatment.

17. The full color image forming apparatus according to item 10, wherein the first and second silica particles are subjected to hydrophobic treatment.

18. The negatively chargeable toner according to item 1, wherein the external additive further comprising a metal soap particle.

19. The process for producing a negatively chargeable toner according to item 9, further comprising a step of adding a metal soap particle to the resin particles.

20. The full color image forming apparatus according to item 10, wherein the external additive further comprising a metal soap particle.

21. The negatively chargeable toner according to item 3, wherein the weight ratio of the surface-modified silica particles to the aluminum oxide-silicon dioxide composite oxide particles is from 2/50 to 50/2.

22. The full color image forming apparatus according to item 10, wherein the work function of the negatively chargeable toner is higher than the work function of the surface of the photoreceptor.

DETAILED DESCRIPTION OF THE INVENTION

Figure 1:
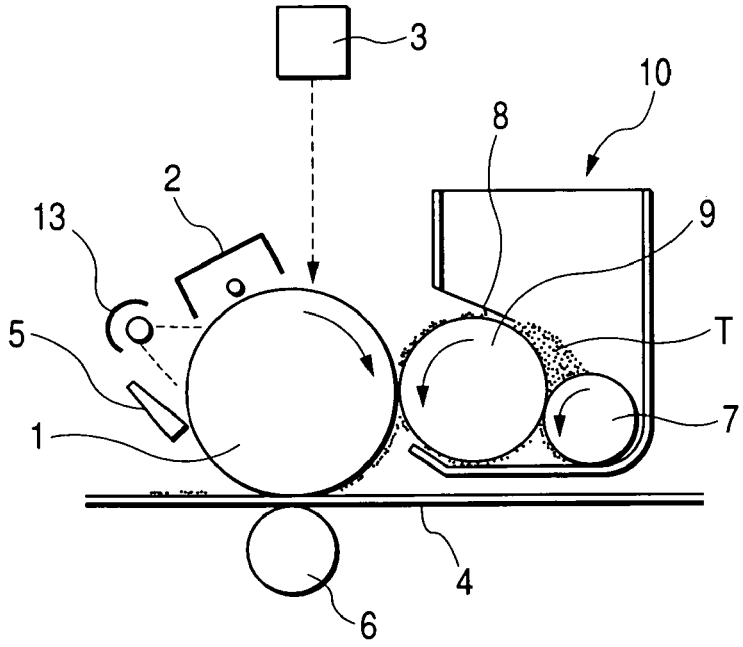
FIG. 1 is a view illustrating an embodiment of a contact developing process in an image forming apparatus using a toner of the present invention.

According to the present invention, it has been discovered that in a negatively chargeable toner comprising: resin particles comprising a colorant; and an external additive which coats the surface of the resin particles, wherein the external additive contains; (1) first silica particles having a number mean primary particle size of 5 to 20 nm and second silica particles having a number mean primary particle size of 30 to 50 nm (hereinafter also referred to as silica particles different in particle size); (2) surface-modified silica particles which are surface modified by wet treatment using an oxide or hydroxide of at least one metal selected from the group consisting of titanium, tin, zirconium and aluminum, and are further subjected to hydrophobic treatment (hereinafter also referred to as surface-modified silica particles); and (3) aluminum oxide-silicon dioxide composite oxide particles obtained by flame hydrolysis and hydrophobic treatment (hereinafter also referred to as aluminum oxide-silicon dioxide composite oxide particles or combined oxide particles) are contained in specified amounts, respectively, as the external additive, thereby enhancing the charge characteristics of the toner and decreasing the amount of reversely charged toner particles, which makes it possible to stabilize the charge characteristics of the toner and to improve the transfer efficiency, allowing the formation of the negatively chargeable toner suitable as a full color toner.

As the toner mother particles, there are exemplified toner particles obtained by a pulverization method or a polymerization method. As for the toner obtained by the pulverization method, a release agent and a charge control agent are added to a binder resin containing at least a pigment, followed by uniform mixing by a Henschel mixer. Then, the resulting mixture is melt kneaded by a twin-screw extruder. After cooling, the melt is roughly pulverized and finely pulverized, and the resulting particles are classified. Further, external additive particles are adhered thereto to form toner particles.

As the binder resin, a synthetic resin used as a resin for toner is available. Examples thereof include homopolymers or copolymers containing styrene or styrene substituents, styrenic resins such as polystyrene, poly-α-methylstyrene, chloropolystyrene, a styrene-chlorostyrene copolymer, a styrene-propylene copolymer, a styrene-butadiene copolymer, a styrene-vinyl chloride copolymer, a styrene-vinyl acetate copolymer, a styrene-maleic acid copolymer, a styrene-acrylate copolymer, a styrene-methacrylate copolymer, a styrene-acrylate-methacrylate copolymer, a styrene-methyl α-chloroacrylate copolymer, a styrene-acrylonitrile-acrylate copolymer and a styrene-vinyl methyl ether copolymer, polyester resins, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenol resins and aliphatic or alicyclic hydrocarbon resins. They can be used either alone or in combination. In the present invention, styrene-acrylate resins, styrene-methacrylate resins and polyester resins are preferred. The binder resin preferably has a glass transition temperature ranging from 50 to 75° C., and a flow softening temperature ranging from 100 to 150° C.

As the colorant, there is available a colorant for toner in which dyes and pigments of yellow, magenta, cyan and black are used either alone or in combination, and a toner having at least 4 colors is used.

Examples of colorants for black (K) include carbon black, lamp black, magnetite and titanium black.

Examples of colorants for yellow (Y) include Chrome Yellow, Hansa Yellow G, Quinoline Yellow, C.I. Pigment Yellow 12, C.I. Pigment Yellow 17, C.I. Pigment Yellow 97, C.I. Pigment Yellow 180, C.I. Solvent Yellow 162 and Benzidine Yellow.

Examples of colorants for magenta (M) include Quinacridone, C.I. Pigment Red 48:1, C.I. Pigment Red 122, C.I. Pigment Red 57:1, C.I. Pigment Red 184 and Rhodamine 6G.

Further, examples of colorants for cyan (C) include ultramarine blue, Aniline Blue, Phthalocyanine Blue, Phthalocyanine Green, Chalco Oil Blue, Rose Bengal, Malachite Green Lake, C.I. Pigment Blue 5:1 and C.I. Pigment Blue 15:3.

As the release agent, there is available a release agent for toner. Examples thereof include paraffin wax, micro wax, microcrystalline wax, candelilla wax, carnauba wax, ester wax, rice wax, montan wax, polyethylene wax, polypropylene wax, oxidized polyethylene wax and oxidized polypropylene wax. Polyethylene wax, polypropylene wax, carnauba wax, ester wax and rice wax are preferably used among others.

As the charge control agent, there is available a charge control agent for toner. Examples thereof include oil black, Oil Black BY, Bontron S-22 and S-34 (manufactured by Orient Chemical Industries, Ltd.), metal complexes of salicylic acid E-81 and E-84 (manufactured by Orient Chemical Industries, Ltd.), a thioindigo-based pigment, a sulfonylamine derivative of copper phthalocyanine, Spilon Black TRH (manufactured by Hodogaya Chemical Co., Ltd.), a calixarene-based compound, an organic boron compound, a fluorine-containing quaternary ammonium salt-based compound, a monoazo metal complex, an aromatic hydroxycarboxylic acid-based metal complex, an aromatic dicarboxylic acid-based metal complex and a polysaccharide. For a color toner, a colorless or white agent is preferred among others.

As for the ratio of components in the toner obtained by the pulverization method, the amount of the colorant is preferably from 0.5 to 15 parts by weight, and more preferably from 1 to 10 parts by weight, the amount of the release agent is preferably from 1 to 10 parts by weight, and more preferably from 2.5 to 8 parts by weight, and the amount of the charge control agent is preferably from 0.1 to 7 parts by weight, and more preferably from 0.5 to 5 parts by weight, based on 100 parts by weight of the binder resin.

In the toner obtained by the pulverization method, in order to improve the transfer efficiency, the toner particles are preferably subjected to spheroidization treatment. When an apparatus in which pulverization into relatively round spherical particles is possible, for example, a turbo mill (manufactured by Kawasaki Heavy Industries, Ltd.) known as a mechanical pulverizer, is used in a pulverization process, the sphericity can be increased to 0.93. Further, the sphericity can be increased to 1.00 by treating the pulverized toner using a hot air spheroidizing apparatus (manufactured by Nippon Pneumatic Mfg. Co., Ltd.). In the present invention, the sphericity is preferably adjusted to 0.94 or more. When the sphericity is less than 0.94, the desired transfer efficiency is not obtained.

Then, the toner obtained by the polymerization method is obtained by a suspension polymerization method, an emulsion polymerization method or a dispersion polymerization method, and can be suitable for a full color toner. In the suspension polymerization, a monomer composition prepared by melting or dispersing a compound material of a polymerizable monomer, a coloring pigment and a release agent, and further, a dye, a polymerization initiator, a crosslinking agent, a charge control agent and other additives as needed is added into an aqueous phase containing a suspension stabilizer (a water-soluble polymer or a slightly water-soluble inorganic material) with stirring, granulated and polymerized, thereby being able to form colored polymerized toner particles having a desired particle size. Of the materials used in the preparation of the toner obtained by the polymerization method, the colorant, release agent and charge control agent may be the same materials as used in the above-mentioned toner obtained by the pulverization method.

In the emulsion polymerization method, a monomer and a release agent, and further, a polymerization initiator, an emulsifier (surfactant) and the like as needed are dispersed in water, and polymerization is conducted. Then, a colorant, a charge control agent and a coagulant (electrolyte) are added in a coagulation process, thereby being able to form colored toner particles having a desired particle size.

As the polymerizable monomer component, there is available a known vinyl monomer. Examples thereof include styrene, o-methylstyrene, m-methylstyrene, p-methylstyrene, α-methylstyrene, p-methoxystyrene, p-ethylstyrene, vinyltoluene, 2,4-dimethylstyrene, p-n-butylstyrene, p-phenylstyrene, p-chlorostyrene, divinylbenzene, methyl acrylate, ethyl acrylate, propyl acrylate, n-butyl acrylate, isobutyl acrylate, n-octyl acrylate, dodecyl acrylate, hydroxyethyl acrylate, 2-ethylhexyl acrylate, phenyl acrylate, stearyl acrylate, 2-chloroethyl acrylate, methyl methacrylate, ethyl methacrylate, propyl methacrylate, n-butyl methacrylate, isobutyl methacrylate, n-octyl methacrylate, dodecyl methacrylate, hydroxyethyl methacrylate, 2-ethylhexyl methacrylate, stearyl methacrylate, phenyl methacrylate, acrylic acid, methacrylic acid, maleic acid, fumaric acid, cinnamic acid, ethylene glycol, propylene glycol, maleic anhydride, phthalic anhydride, ethylene, propylene, butylene, isobutylene, vinyl chloride, vinylidene chloride, vinyl bromide, vinyl fluoride, vinyl acetate, vinyl propionate, acrylonitrile, methacrylonitrile, vinyl methyl ether, vinyl ethyl ether, vinyl ketone, vinyl hexyl ketone and vinylnaphthalene. As fluorine-containing monomers, there are available, for example, 2,2,2-trifluoroethyl acrylate, 2,2,3,3-tetrafluoropropyl acrylate, vinylidene fluoride, ethylene trifluoride, tetrafluoroethylene and trifluoropropylene, because the fluorine atoms are effective for negative charge control.

The emulsifiers (surfactants) include, for example, sodium dodecylbenzenesulfonate, sodium tetradecylsulfate, sodium pentadecylsulfate, sodium octylsulfate, sodium oleate, sodium laurate, potassium stearate, calcium oleate, dodecylammonium chloride, dodecylammonium bromide, dodecyltrimethylammonium bromide, dodecylpyridinium chloride, hexadecyltrimethylammonium bromide, dodecyl polyoxyethylene ether, hexadecyl polyoxyethylene ether, lauryl polyoxyethylene ether and sorbitan monooleate polyoxyethylene ether.

The polymerization initiators include, for example, potassium persulfate, sodium persulfate, ammonium persulfate, hydrogen peroxide, 4,4'-azobiscyanovaleric acid, t-butyl hydroperoxide, benzoyl peroxide and 2,2'-azobisisobutyronitrile.

The coagulants (electrolytes) include, for example, sodium chloride, potassium chloride, lithium chloride, magnesium chloride, calcium chloride, sodium sulfate, potassium sulfate, lithium sulfate, magnesium sulfate, calcium sulfate, zinc sulfate, aluminum sulfate and iron sulfate.

As methods for controlling the sphericity of the toner obtained by the polymerization method, in the emulsion polymerization method, the temperature and time are adjusted in a coagulation process of secondary particles, thereby being able to freely change the sphericity. The range thereof is from 0.94 to 1.00. Further, in the suspension polymerization method, perfect spherical toner particles are obtainable, so that the sphericity ranges from 0.98 to 1.00. However, the sphericity can be freely controlled from 0.94 to 0.98 by deforming the toner particles by heating them at a temperature higher than the glass transition temperature (Tg) of the toner.

Further, for both the toner obtained by the pulverization method and the toner obtained by the polymerization method, the number mean particle size of the toner is preferably 9 μm or less, and more preferably from 4.5 to 8 μm. Toner particles having a number mean particle size larger than 9 μm are deteriorated in reproducibility of the resolution thereof, compared to toner particles having a smaller particle size, even when a latent image is formed at a high resolution of 1,200 dpi or more. On the other hand, when the particle size is smaller than 4.5 μm, opacifying properties by the toner are lowered, and the amount of an external additive added for enhancing fluidity increases. As a result, there is unfavorably a tendency to lower fixing performance. The above-mentioned mean particle size of the toner mother particles and toner particles in the present invention is a value measured with a particle image analyzer (manufactured by Sysmex Corporation, FPIA2100), and means the number mean particle size.

The external additives will be described below. The surfaces of the toner mother particles are coated with the two kinds of silica particles different in mean primary particle size, the surface-modified silica particles and further the aluminum oxide-silicon dioxide composite oxide particles as the external additives, in specified amounts, respectively. The particle size of the external additive in the present invention is observed and measured by electron microscope, and means the number mean particle size.

The silica particles are added in order to impart the negatively chargeable property and fluidity. In the present invention, the silica particles are used as a mixture of silica particles different in the mean particle size distribution. Small-sized silica particles having a mean primary particle size of 5 to 20 nm, preferably 7 to 16 nm are used in combination with large-sized silica particles having a mean primary particle size of 30 to 50 nm, preferably 30 to 40 nm. The small-sized particles can provide the fluidity and negatively chargeable property, while the large-sized particles can prevent the external additive particles from being embedded in the toner mother particles. When the mean particle size of the primary particles of the silica particles is smaller than 5 nm, the silica particles become liable to be embedded in the mother particles of the toner, and become liable to be negatively charged. On the other hand, exceeding 50 nm results in deterioration of the effect of imparting the fluidity to the toner mother particles, which makes it difficult to uniformly negatively charge the toner, resulting in the tendency to increase the amount of toner particles reversely charged, i.e., positively charged.

The silica particles are added in an amount of preferably 0.5 to 1.5% by weight per toner mother particles. Less than 0.5% by weight results in failure to provide the effect of imparting the fluidity, whereas exceeding 1.5% by weight unfavorably causes deterioration of the fixability. Further, the ratio (weight ratio) of the small-sized silica particles to the large-sized silica particles is preferably from 5/1 to 1/5. Too much the small-sized particles bring about deterioration of the fixability, whereas too little lead to a reduction in fluidity.

In the present invention, it is preferable that the silica particles are subjected to hydrophobic treatment. In the present invention, either of particles prepared from a silicon halide by a dry process and particles precipitated from a silicon compound in a solution by a wet process can be preferably used.

Then, the surface-modified silica particles are prepared by a method described in reference 2, and obtained by adding dropwise an aqueous solution of an oxide or hydroxide of at least one metal selected from titanium, tin, zirconium and aluminum into an aqueous dispersion of silica particles produced by a wet process or a gas phase process and having a specific surface of 50 to 400 $m^2/g$. As for the amount coated, the oxide or hydroxide of at least one metal selected from titanium, tin, zirconium and aluminum is applied in an amount of 1 to 30% by weight based on the silica particles.

The surface-modified silica particles are subjected to hydrophobic treatment by adding an alkoxysilane into a slurry in which the surface-modified silica particles have been formed, generally in an amount of 30 to 50% by weight based on the fine silica particles, followed by filtration, washing and drying to prepare hydrophobic-treated, surface-modified silica particles. The hydrophobilization treatment may be conducted by adding an alkoxylsilane and using a Henschel mixer after filtration, washing and drying of the surface-modified silica particles. The number-based mean primary particle size of the hydrophobic-treated, surface-modified silica particles is preferably from 5 to 50 nm, and more preferably from 7 to 40 nm.

The surface-modified silica particles are preferably added in an amount of 0.005 to 0.5% by weight, more preferably 0.08 to 0.5% by weight, based on the toner mother particles. The surface-modified silica particle has a negative frictional charge site based on the silica component, and a positive frictional charge site based on the titanium, tin, zirconium or aluminum component, so that it has the function of preventing excessive charge caused by the silica particle. It is therefore conceivable that stable image formation can be performed. Further, the silica component constituting a base in the surface-modified silica particle is fixedly adhered to a surface of the toner through the silica particle. As a result, it is conceivable that the liberating rate of the external additives in continuous printing is decreased, which makes it possible to impart stable charge characteristics for a long period of time. When the surface-modified silica particles are added in an amount of more than 0.5% by weight, the problem is encountered that the positive frictional charge sites increase to many. It is therefore unfavorable. In the following examples and the like, descriptions are made for examples in which the silica particles are surface modified with the titanium compound. However, the surface-modified silica particles surface modified with the tin, zirconium or aluminum compound also exhibit a similar action.

Then, the aluminum oxide-silicon dioxide composite oxide particles are prepared by a method for producing a fine aluminum oxide-silicon dioxide composite oxide particles, which is described in reference 4 and comprises the following preparation steps:

(1) A silicon halide and an aluminum halide are evaporated, and the respective vapors are homogeneously combined with air, oxygen and hydrogen, together with a carrier gas, in a combining unit;

(2) Then, the resulting combined vapor is supplied to a burner to conduct flame hydrolysis reaction in a combustion chamber, and the resulting gas and solid are cooled in a heat exchange unit; and (3) The gas is separated from the solid, and halide residues adhering to the product are removed by heat treatment using wet air to obtain the combined oxide particles.

The proportions of $Al_2O_3$ and $SiO_2$ are appropriately adjusted by reaction conditions such as the amounts of the silicon halide and aluminum halide supplied, the amount of hydrogen supplied and the amount of the air supplied. It is preferable that the content of $Al_2O_3$ is adjusted within the range of 55 to 85% by weight, and also preferable that the content of $SiO_2$ is adjusted within the range of 15 to 45% by weight. Further, the combined oxide particles are granulated in the flame, thereby providing particles having an amorphous structure, sufficient fine graininess and a specific surface area determined by the BET method of 20 to 200 $m^2/g$ in general. The primary particle size of the combined oxide particles is preferably from 7 to 80 nm, and more preferably from 10 to 40 nm, and particles having a particle size of 20 nm or more preferably occupy 30% or more based on the number.

It is preferable that the combined oxide particles are added in an amount of 0.005 to 0.5% by weight, more preferably 0.08 to 0.5% by weight, based on the toner mother particles.

It is conceivable that the combined oxide particles give two frictional charge sites of positive and negative when added to the toner mother particles. However, it is conceivable that the combined oxide particles are not mere mixed particles of aluminum oxide particles and silicon oxide particles, but aluminum oxide and silicon oxide are combined with each other in the particle. Accordingly, it is conceivable that the charge easily transfers in the particle to effectively prevent excessive charge of the toner particles.

As for the use ratio of the surface-modified silica particles (A) and the combined oxide particles (B), it is preferable that (A):(B) is from 2/50 to 50/2 by weight ratio, and that the total amount of both the surface-modified silica particles and the combined oxide particles added is preferably from 0.01 to 1% by weight, more preferably from 0.02 to 0.8% by weight, per the toner mother particles. Even when the surface-modified silica particles are independently added to the toner particles coated with the negatively chargeable silica particles, the charge is insufficiently maintained. Further, when the combined oxide particles are independently added to the toner particles coated with the negatively chargeable silica particles, the prevention of excess charge is insufficiently maintained.

In the present invention, the surface-modified silica particles and the combined oxide particles are externally added to the toner particles coated with the negatively chargeable silica particles, thereby being able to decrease the positively charged toner amount of the toner particles to prepare toner particles suitable for full colorization. In the surface-modified silica particles or the combined oxide particles alone, the titanium, tin, zirconium or aluminum component in the surface-modified silica particles, or the aluminum oxide component in the combined oxide particles functions as a positive charge site, which causes the problem that the reverse transfer toner is developed to increase fogging, furthermore leading to a decrease in transfer efficiency.

Further, when the surface-modified silica particles or the combined oxide particles are used in combination with the silica particles, the amount of external additives can be reduced compared to the conventional addition system of silica, titania, alumina or the like, so that the fixability is not lowered.

In the present invention, it is possible to use various other inorganic and organic external additives for toner in combination with the above-mentioned external additives, as long as the functions thereof are not impaired. Examples thereof include positively chargeable silica, alumina, zinc oxide, magnesium fluoride, silicon carbide, boron carbide, titanium carbide, zirconium carbide, boron nitride, titanium nitride, zirconium nitride, zirconium oxide, calcium carbonate, magnetite, molybdenum disulfide, a metal titanate such as strontium titanate, a silicon metal salt, and fine particles of a resin such as an acrylic resin, a styrene resin or a fluororesin.

In the present invention, it is possible to use various other inorganic and organic external additives for toner in combination with the above-mentioned external additives, as long as the functions thereof are not impaired. Examples thereof include positively chargeable silica, alumina, zinc oxide, magnesium fluoride, silicon carbide, boron carbide, titanium carbide, zirconium carbide, boron nitride, titanium nitride, zirconium nitride, zirconium oxide, calcium carbonate, magnetite, molybdenum disulfide, a metal titanate such as strontium titanate, a silicon metal salt, and fine particles of a resin such as an acrylic resin, a styrene resin or a fluororesin.

Further, metal soap particles are preferably added as the external additive particles, which lowers the number liberating rate of the external additive particles, prevents the occurrence of fogging, and makes it possible to prevent scratches from occurring on a surface of the photoreceptor and to improve the transfer efficiency.

The metal soap particles are a higher fatty acid salt of a metal selected from zinc, magnesium, calcium and aluminum, and examples thereof include magnesium stearate, calcium stearate, zinc stearate, monoaluminum stearate and trialuminum stearate. The mean particle size of the metal soap particles is preferably from 0.5 to 20 μm, and more preferably from 0.8 to 10 μm.

The amount of the metal soap particles added is preferably 0.05 to 0.5% by weight, and more preferably from 0.1 to 0.3% by weight, based on the toner mother particles. Less than 0.05% by weight results in insufficient functions as a lubricant and a binder, whereas exceeding 0.5% by weight results in the tendency of fogging to increase in reverse. It is preferable that the metal soap particles are added in an amount of 2 to 10% by weight based on the above-mentioned external additives. Less than 2% by weight unfavorably shows no effects as a lubricant and a binder, whereas exceeding 10% by weight unfavorably leads to a reduction in fluidity and an increase in fogging.

Then, as a method for externally adding various external additives to the toner mother particles, it is preferable to first externally add two kinds of hydrophobic silica particles different in particle size to the toner mother particles, and then, externally add the metal soap particles together with the surface-modified silica particles and the combined oxide particles. The work function of the hydrophobic silica particles is preferable from 5.0 to 5.3 eV, when measured by a method described later, and the work function of the toner mother particles is preferably from 5.3 to 5.8 eV. In the negatively chargeable toner, the external additive particles having a smaller work function are fixedly adhered to surfaces of the toner mother particles by charge transfer caused by the difference in the work function. Then, it is conceivable that the surface-modified silica particles and the combined oxide particles added in the after process are fixedly adhered to the silica particles on surfaces of the toner particles through the silica component thereof and to surfaces of the toner mother particles.

Further, the metal soap particles are adhered to the vicinities of the silica particles, surface-modified silica particles and combined oxide particles on the surfaces of the toner mother particles, or directly to the surfaces of the toner mother particles. However, by adjusting the work function of the toner mother particles approximately to that of the metal soap particles (the difference in absolute value is within 0.15 eV), it conceivably becomes possible (1) to maintain the fluidity and charge property of the toner mother particles without inhibiting the characteristics of giving the fluidity and charge property, which are functions of the inorganic additive particles, (2) to more decrease the number liberating rate of the external additive particles to more prevent the occurrence of fogging, because the charge transfer in the external additive particles is not inhibited, and (3) to easily transfer the metal soap particles from the toner particles to a surface of a latent image carrier, to more prevent the occurrence of scratches on the surface of the latent image carrier in cleaning and to improve the transfer efficiency, because the adhesion of the metal soap particles to the toner mother particles can be weakened.

Further, the work function of the surface-modified silica particles added in the after process is preferably from 5.2 to 5.5 eV, and the work function of the combined oxide particles indicates two kinds of work functions, a first work function ranging from 5.0 to 5.4 and a second work functions ranging from 5.4 to 5.7, as described in reference 5 previously filed by the present assignee. It is conceivable that both the surface-modified silica particles and the combined oxide particles are adhered to the vicinities of the silica particles on the surfaces of the toner particles, or to the toner mother particles.

The work function (Φ) is known as energy necessary for taking electrons out of a material. The smaller the work function is, the more easily the electron is released, and the larger the work function is, the more difficult the electron is to be released. Accordingly, when a material having a smaller work function is brought into contact with a material having a larger work function, the material having a smaller work function is positively charged, and the material having a larger work function is negatively charged. The work function is numerically indicated as energy (eV) for taking electrons out of a material, and can evaluate the charge property by contact between various materials. The work function (Φ) is measured using a surface analyzer (manufactured by Riken Keiki Co., Ltd., AC-2, a low-energy counting system). In this analyzer, a sample is irradiated, using a heavy hydrogen lump, setting the dose of irradiating light to 500 nW, selecting a monochromic light with a spectrograph, and setting the irradiation area to 4 mm square, within the energy scanning range of 3.4 to 6.2 eV for a measuring time of 10 sec/position. The work function (Φ) is determined by detecting photoelectrons emitted from a surface of the sample, and measured with a repetition accuracy (standard deviation) of 0.02 eV. In order to ensure the repeatability of data, the sample is used as a sample to be measured after it has been allowed to stand under conditions of a temperature of 25° C. and an RH of 55% for 24 hours. Samples to be measured of the toner mother particles, the external additive particles, the metal soap particles and the toner particles are measured using a measuring cell for toner exclusive use.

The external additive particles used in the present invention are preferably subjected to hydrophobic treatment with a silane coupling agent, a titanium coupling agent, a higher fatty acid, a silicone oil or the like to use. The hydrophobilization rate is preferaby 40% or more, and more preferably 50% or more. The hydrophobilizing agents include, for example, dimethyldichlorosilane, octyltrimethoxysilane, hexamethyldisilazane, silicone oil, octyltrichlorosilane, decyltrichlorosilane, nonyltrichlorosilane, (4-iso-propylphenyl)trichlorosilane, (4-t-butylphenyl)trichlorosilane, dipentyldichlorosilane, dihexyldichlorosilane, dioctyldichlorosilane, dinonyldichlorosilane, didecyldichlorosilane, didodecyldichlorosilane, (4-t-butylphenyl)octyldichlorosilane, didecenyldichlorosilane, dinonenyldichlorosilane, di-2-ethylhexyldichlorosilane, di-3,3-dimethylpentyldichlorosilane, trihexylchlorosilane, trioctylchlorosilane, tridecylchlorosilane, dioctylmethylchlorosilane, octyldimethylchlorosilane and (4-iso-propylphenyl)diethylchlorosilane. After coupling treatment, the particles may be further treated with a silicone oil or the like to further enhance hydorophobicity.

The amount of the external additive particles added as a whole is preferably from 0.51 to 2.5% by weight, and more preferably from 0.8 to 2.3% by weight, based on the toner mother particles. Less than 0.51% by weight results in no effect of imparting the fluidity and preventing excessive charge, whereas exceeding 2.5% by weight results in a decrease in the amount of negative charge and concurrently in an increase in the amount of positively charged toner having the reverse polarity, which increases fogging and the amount of reverse transfer toner to results in unsuitability for full color applications.

In the method for producing the toner of the present invention, it is preferred that the hydrophobic silica particles are first externally added to the toner mother particles, and then, the surface-modified silica particles, the combined oxide particles or the metal soap particles are externally added thereto, as described above. Each external additive is preferably added to the toner mother particles with a Henschel mixer (manufactured by Mitsui Miike Machinery Co., Ltd.), a mechanofusion system (manufactured by Hosokawa Micron Co., Ltd.) or Mechanomill (manufactured by Okada Seiko Co., Ltd.). When the Henschel mixer is used, it is preferably operated at 5,000 to 7,000 rpm for 1 to 3 -minutes in addition of the hydrophobic silica particles in the first step, and it is preferably operated at 5,000 to 7,000 rpm for 1 to 3 minutes in addition of the surface-modified silica particles, the combined oxide particles and the metal soap particles in the second step.

The work function of the negatively chargeable toner thus obtained is preferably from 5.3 to 5.9 eV, and more preferably from 5.4 to 5.85 eV. Fogging can be more reduced, and the transfer efficiency can be more improved by increasing the work function of the negatively chargeable toner more than the work function of the surface of the photoreceptor, as described in Examples. Further, in regulating the formation of a thin film of the toner on a developing roller with a toner regulating member, the "excessive charge" phenomenon that the amount of charge in the negatively chargeable toner is extremely increased occurs in some times. However, when the work function of the negatively chargeable toner is decreased, compared to the work function of the surface of the photoreceptor, this phenomenon can be inhibited.

The negatively chargeable toner of the present invention, for the toner obtained by the pulverization method, has a number-based mean particle size of preferably from 5 to 10 μm, more preferably from 6 to 9 μm. The negatively chargeable toner of the present invention, for the toner obtained by the polymerization method, preferably has a particle size distribution such that 50% or more of particles having a number-based mean particle size of 8 μm or less, more preferably from 4.5 to 8 μm, and 10% or less, more preferably 5% or less of particles having a number-base particle size of 3 μm or less.

In both cases of the pulverization method and the polymerization method, the negatively chargeable toner of the present invention preferably has a sphericity (spheroidization coefficient) of 0.94 or more, more preferably 0.95 or more. When the sphericity (spheroidization coefficient) is up to 0.97, a cleaning blade is preferably used, and when it is 0.97 or more, brush cleaning is preferably used in combination therewith. The transfer efficiency can be improved by adjusting the sphericity (spheroidization coefficient) of the toner to 0.94 or more.

The mean particle size and the sphericity (spheroidization coefficient) of the toner mother particles and the toner particles are values measured with an "FPIA2100" analyzer manufactured by Sysmex Corporation. Further, the mean particle size of the external additive particles is a value measured by electronography.

The image forming apparatus of the present invention will be described below. FIG. 1 shows an embodiment of a contact developing process in the image forming apparatus using the toner of the present invention.

A photoreceptor 1 is a photoreceptor drum which generally has a diameter of 24 to 86 mm and generally rotates at a surface speed of 60 to 300 mm/sec, and after a surface thereof has been uniformly negatively charged with a corona charging device 2, exposure to light 3 is carried out depending on information to be recorded, thereby forming an electrostatic latent image. A developing device 10 is a single-component developing apparatus, which supplies a single-component non-magnetic toner T onto the photoreceptor 1, thereby reversely developing the electrostatic latent image on the photoreceptor 1 to form a visible image. The single-component non-magnetic toner T is contained in a developing means, and supplied to a developing roller 9 with a toner supply roller 7 which rotates counterclockwise as shown in FIG. 1. The developing roller 9 rotates counterclockwise, and conveys the toner T supplied with the toner supply roller 7 to a contact portion with the photoreceptor 1, with the toner T held on a surface thereof. Then, the electrostatic latent image on the photoreceptor 1 is made visible.

The developing roller 9 is, for example, a roller having a diameter of 16 to 24 mm in which a metal pipe is plated or treated by blasting, or in which a conductive elastic layer having a volume resistance of $10^4$ to $10^8$ Ω·cm and a hardness (Asker A hardness) of 40 to 70° is generally formed on a central axis peripheral surface of a metal pipe, the conductive elastic layer comprising a butadiene rubber, a styrene-butadiene rubber, an ethylene-propylene rubber, a urethane rubber, a silicone rubber or the like. Developing bias voltage is applied from a power source (not shown) through a shaft of this pipe. Further, the developing device 10 comprising the developing roller 9, the toner supply roller 7 and a toner regulating blade 8 is preferably pressed to the photoreceptor 1 with a biasing means such as a spring (not shown) with a pressing force of 19.6 to 98.1 N/m, more preferably 24.5 to 68.6 N/m so as to give a nip width of 1 to 3 mm.

As the regulating blade 8, there is used a blade obtained by laminating rubber tips with stainless steel, phosphor bronze, a rubber plate or a thin metal plate. The blade is preferably pressed to the developing roller 9 with a biasing means such as a spring (not shown) or utilizing repulsive force as an elastic material, with a preferable line pressure of 245 to 490 mN/cm, thereby forming two or more toner layers on the developing roller.

In the contact developing process, the dark potential of photoreceptor 1 is preferably from −500 to −700 V, and the light potential thereof is preferably from −50 to −150 V. Although not shown, the developing bias voltage is preferably −100 to −400 V, and the developing roller 9 and the toner supply roller 7 preferably have the same potential.

In the contact developing process, the ratio of the peripheral speed of the developing roller 9 which rotates counterclockwise to that of the photoreceptor 1 which rotates clockwise is preferably set to 1.2 to 2.5, more preferably 1.5 to 2.2, thereby being able to make sure contact frictional charge with the photoreceptor 1 even when the toner particles are small in size.

There is no particular limitation on the relationship between the respective work functions of the regulating blade 8 and the developing roller 9 and the work function of the toner. However, the respective work functions of the regulating blade 8 and the developing roller 9 are made smaller than the work function of the toner to cause negative contact charge in the toner in contact with the regulating blade 8, thereby being able to obtain the more uniformly negatively charged toner. Further, voltage may be applied to the regulating blade 8 to inject charge into the toner, thereby controlling the amount of charge in the toner.

The intermediate transfer medium used in the image forming apparatus of the present invention will be described below. In FIG. 1, an intermediate transfer medium 4 is sent between the photoreceptor 1 and a back-up roller 6, and a visible image on the photoreceptor 1 is transferred onto the intermediate transfer medium 4 by application of voltage to form a toner image on the intermediate transfer medium 4. The toner remaining on the photoreceptor 1 is removed with a cleaning blade 5, and electrostatic charge on the photoreceptor 1 is erased with an erasing lamp. Thus, the photoreceptor 1 is reused. In the image forming apparatus of the present invention, reversely charged toner particles can be inhibited, so that the amount of the toner remaining on the photoreceptor 1 can be decreased, thereby being able to minimize a cleaning toner container. The pressing force of the intermediate transfer medium 4 to the photoreceptor 1 by the back-up roller 6 is preferably from 18.8 to 45.2 N/m, more preferably from 26.3 to 37.7 N/m.

When a transfer drum or a transfer belt is used as the intermediate transfer medium 4, a voltage of +250 to +600 V is preferably applied as primary transfer voltage to a conductive layer thereof, and in secondary transfer to a transfer material such as paper, a voltage of +400 to +2,800 V is preferably applied as secondary transfer voltage.

The transfer drum or the transfer belt can be used as the intermediate transfer medium. As the transfer belt, one is a belt in which a transfer layer is provided on a film or a sheet comprising a substrate made from a synthetic resin, and the other is a belt in which a transfer layer is provided as a surface layer on a base layer of an elastic material. As the transfer drum, when an organic photosensitive layer is provided on a drum having rigidity, for example, a drum made of aluminum, a transfer layer which is an elastic surface layer is provided on a drum substrate having rigidity such as an aluminum substrate to form the transfer medium. Further, when a support of the photoreceptor is in belt form, or a so-called elastic photoreceptor in which a photosensitive layer is provided on an elastic support such as a rubber support, a transfer layer is preferably provided on a drum having rigidity, for example, a drum made of aluminum, directly or with the interposition of a conductive intermediate layer. As the substrate, there can be used a conductive or insulating substrate. In the case of the transfer belt, the volume resistance is preferably within the range of $10^4$ to $10^{12}$ Ω·cm, more preferably $10^6$ to $10^{11}$ Ω·cm.

As for a material suitable for the film or the sheet and a method for preparing the same, a conductive material such as conductive carbon black, conductive titanium oxide, conductive tin oxide or conductive silica is dispersed in an engineering plastic resin such as a modified polyimide, a thermosetting polyimide, a polycarbonate, an ethylene—tetrafluoroethylene copolymer, polyvinylidene fluoride or a nylon alloy, the resulting resin composition is extruded to form a semiconductive film generally having a thickness of 50 to 500 μm, or molded to form a seamless substrate, and a fluororesin coating generally having a thickness of 5 to 50 μm is formed on an outer side thereof as a surface protective layer for reducing surface energy and preventing filming of the toner, thereby obtaining a seamless belt.

As a method for forming the surface protective layer, there can be used a dip coating method, a ring coating method, a spray coating method or the like. In order to prevent cracking and elongation at edges of the transfer belt and a meandering movement thereof, tapes made of a polyethylene terephthalate film generally having a thickness of 80 μm or ribs made of a urethane rubber are attached on both edges of the transfer belt.

When the substrate is prepared from the film or the sheet, in order to form a belt-like substrate, edges thereof are ultrasonic welded, thereby being able to prepare a belt. Specifically, a conductive layer and a surface layer are provided on the sheet or the film, and then, ultrasonic welding is conducted, thereby being able to prepare the transfer belt having desired physical properties. More specifically, when a polyethylene terephthalate film having a thickness of 60 to 150 μm is used as the insulating substrate, aluminum is deposited over a surface thereof, or an intermediate layer comprising a resin and a conductive material such as carbon black is further formed thereon by coating, and a semiconductive surface layer comprising a urethane resin, a fluororesin and a conductive material, which has a surface resistance higher than that of the intermediate surface layer, is provided thereon, thereby being able to form the transfer belt. When a resistive layer can be provided which does not require such a large amount of heat in drying after coating, it is also possible to provide the above-mentioned resistive layer after the ultrasonic welding of the aluminum-deposited film, thereby preparing the transfer belt.

As for a material suitable for the elastic substrate such as a rubber and a method for preparing the same, the above-mentioned conductive material is dispersed in a silicone rubber, a urethane rubber, a nitrile rubber, an ethylene-propylene rubber or the like, the resulting rubber composition is extruded to form a semiconductive rubber belt generally having a thickness of 0.8 to 2.0 mm, and then, a surface thereof is polished with an abrasive such as a sand paper or a polisher to control the surface roughness to a desired value. Although an elastic layer obtained at this time may be used as such, a surface protective layer can be provided in a similar manner as described above.

In the case of the transfer drum, the volume resistance is preferably within the range of $10^4$ to $10^{12}$ Ω·cm, more preferably $10^7$ to $10^{11}$ Ω·cm. The transfer drum can be prepared by providing a conductive intermediate layer of an elastic material on a cylinder of a metal such as aluminum as needed to form a conductive elastic substrate, and forming thereon, for example, a fluororesin coating generally having a thickness of 5 to 50 μm as a surface protective layer for reducing surface energy and preventing filming of the toner.

As the conductive elastic substrate, for example, a conductive material such as carbon black, conductive titanium oxide, conductive tin oxide or conductive silica is blended with, kneaded with and dispersed in a rubber material such as a silicone rubber, a urethane rubber, a nitrile rubber (NBR), an ethylene-propylene rubber (EPDM), a butadiene rubber, a styrene-butadiene rubber, an isoprene rubber, a chloroprene rubber, a butyl rubber, an epichlorohydrin rubber or a fluororubber, and the resulting conductive rubber material is molded so as to adhere to an aluminum cylinder having a preferable diameter of 90 to 180 mm, thereby forming a layer having a preferable thickness after polishing of 0.8 to 6 mm and a preferable volume resistance of $10^4$ to $10^{10}$ Ω·cm. Then, a semiconductive surface layer preferably having a thickness of about 15 to 40 μm, which comprises a urethane resin, a fluororesin, a conductive material and fluorine-based resin particles, thereby being able to form the transfer drum having a desired volume resistance of $10^7$ to $10^{11}$ Ω·cm. The surface roughness thereof at this time is preferably 1 μm (Ra) or less. Further, as another example, it is also possible to cover the conductive elastic substrate prepared as described above with a semiconductive tube of a fluororesin or the like and to allow the tube to contract by heating, thereby preparing the transfer drum having the desired surface layer and electric resistance.

Figure 2:
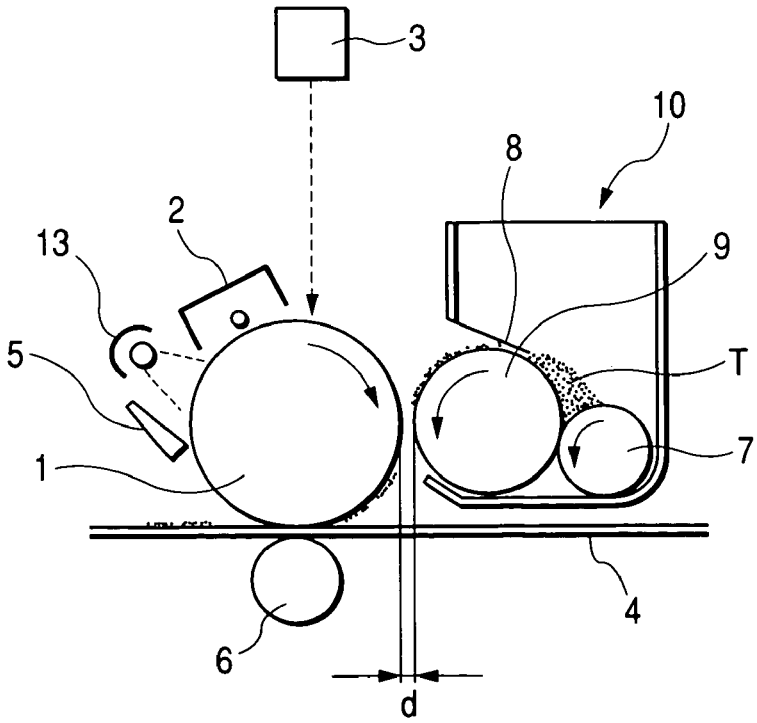
FIG. 2 is a view illustrating an embodiment of a non-contact developing process in an image forming apparatus using a toner of the present invention.

Then, FIG. 2 shows an example of a non-contact developing process in the image forming apparatus using the toner of the present invention. In this process, a developing roller 9 and a photoreceptor 1 face each other through a developing gap d. The developing gap is preferably from 100 to 350 μm. Further, although not shown, the developing bias of DC voltage is preferably from −200 to −500 V, AC voltage superimposed thereon is preferably from 1.5 to 3.5 kHz, and P-P voltage is preferably from 1,000 to 1,800 V. Furthermore, in the non-contact developing process, the ratio of the peripheral speed of the developing roller which rotates counterclockwise to that of an photoreceptor 1 which rotates clockwise is preferably set to 1.0 to 2.5, more preferably 1.2 to 2.2.

The developing roller 9 rotates counterclockwise as shown in FIG. 2, and conveys a toner T supplied with a toner supply roller 7 to a portion opposite to the photoreceptor 1, with the toner T adsorbed on a surface thereof. The toner T vibrates between a surface of the developing roller 9 and a surface of the photoreceptor 1 by applying the AC voltage by a superposition in a portion where the photoreceptor 1 and the developing roller 9 face each other, thereby conducting development. In the present invention, the toner particles can be brought into contact with the photoreceptor 1 while the toner T vibrates between the surface of the developing roller 9 and the surface of the photoreceptor 1 by application of the AC voltage. Accordingly, it is conceivable that small-sized positively charged toner particles can be negatively charged, thereby being able to reduce fogging.

An intermediate transfer medium 4 is sent between the photoreceptor 1 on which an image is visualized and a back-up roller 6. The pressing force of the intermediate transfer medium to the photoreceptor 1 by the back-up roller 6 is preferably increased about 30% compared to the contact developing process, that is to say, preferably from 24.5 to 58.8 N/m, more preferably from 34.3 to 49 N/m.

Further, the peripheral velocity ratio of the photoreceptor 1 to the intermediate transfer medium 4 is preferably from 0.95 to 1.05.

This can make sure the contact between the toner particles and the photoreceptor 1, and the toner particles can be more negatively charged to improve the transfer efficiency.

Items other than the above in the non-contact developing process are the same as with the contact developing process described above.

When developing devices using four color toners (developing agents) comprising yellow Y, cyan C, magenta M and black K are combined with the photoreceptor in the developing processes shown in FIGS. 1 and 2, an apparatus which can form a full color image can be provided.

Figure 3:
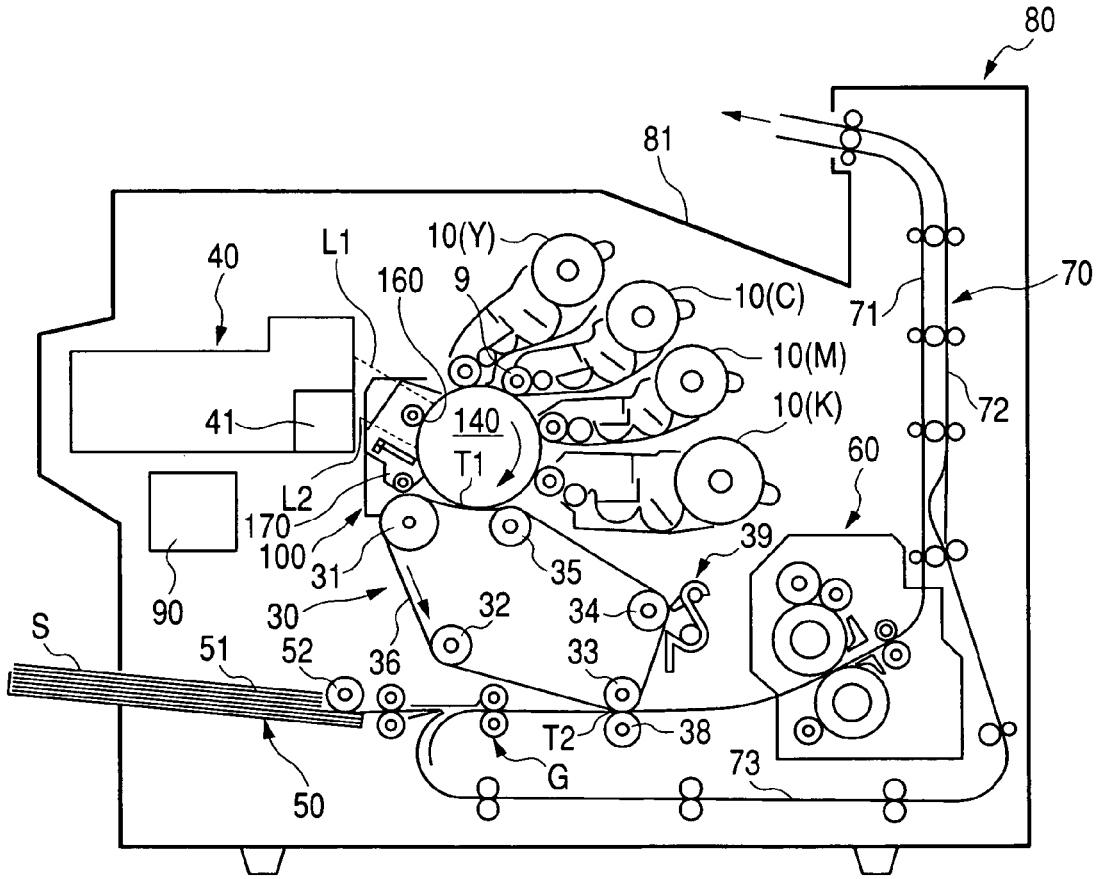
FIG. 3 is a view illustrating an embodiment of a full color printer of a 4-cycle system using a toner of the present invention.

The full color image forming apparatus to which the negatively chargeable toner of the present invention is applied will be described below. FIG. 3 is a view for illustrating an embodiment of a full color printer of a 4-cycle system.

In FIG. 3, the reference numeral 100 designates an image carrier cartridge into which an image carrier unit is incorporated. In this embodiment, the image carrier cartridge is constituted as a photoreceptor cartridge, and a photoreceptor and developing units can be separately mounted. An electrophotographic photoreceptor (latent image carrier) 140 is driven for rotation in the direction indicated by the arrow in FIG. 3 with an appropriate driving means not shown. Around the photoreceptor 140, a charging roller 160 as a charging means, developing devices 10 (Y, M, C, K) as developing means, an intermediate transfer device 30 and a cleaning unit 170 are arranged along its rotational direction.

The charging roller 160 is brought into abutting contact with an outer peripheral surface of the photoreceptor 140 to uniformly charge the outer peripheral surface. The uniformly charged outer peripheral surface of the photoreceptor 140 is selectively exposed to light L1 corresponding to desired image information with an exposure unit 40, and this exposure to light L1 forms an electrostatic latent image on the photoreceptor 140. This electrostatic latent image is developed by adding developing agents with the developing devices 10.

As the developing devices, there are provided a developing device 10Y for yellow, a developing device 10M for magenta, a developing device 10C for cyan and a developing device 10K for black. These developing devices 10Y, 10M, 10C and 10K are each rockably constituted so that only a developing roller 9 of one developing device is selectively brought into press contact with the photoreceptor 140. These developing devices 10 each hold negatively charged toners on the respective developing rollers, and give any one toner of yellow Y, magenta M, cyan C and black K to a surface of the photoreceptor 140 to develop the electrostatic latent image on the photoreceptor 140. The developing roller 9 is constituted by a hard roller, for example, a metal roller whose surface is roughened. The developed toner image is transferred onto an intermediate transfer belt 36 of the intermediate transfer device 30. The cleaning unit 170 comprises a cleaner blade for scrapping off the toner T adhering to the outer peripheral surface of the photoreceptor 140 after the above-mentioned transfer, and a cleaning toner-collecting member for receiving the toner scrapped off with the cleaner blade.

The intermediate transfer device 30 comprises a driving roller 31, four driven rollers 32, 33, 34 and 35, and an endless intermediate transfer belt 36 laid around these rollers under tension. A gear (not shown) fixed at an end of the driving roller 31 engages with a driving gear of the photoreceptor 140, whereby the driving roller 31 is driven for rotation at a peripheral speed approximately similar to that of the photoreceptor 140. Accordingly, the intermediate transfer belt 36 is driven for circulation at a peripheral speed approximately similar to that of the photoreceptor 140 in the direction indicated by the arrow in FIG. 3.

The driven roller 35 is disposed at such a position that the intermediate transfer belt 36 is brought into press contact with the photoreceptor 140 by the tension of itself between the driven roller 35 and the driving roller 31, and a primary transfer portion T1 is formed at a position at which the intermediate transfer belt 36 is brought into press contact with the photoreceptor 140. The driven roller 35 is disposed near the primary transfer portion T1 upstream in the circulating direction of the intermediate transfer belt.

An electrode roller (not shown) is disposed on the driving roller 31 with the interposition of the intermediate transfer belt 36, and primary transfer voltage is applied to a conductive layer of the intermediate transfer belt 36 through this electrode roller. The driven roller 32 is a tension roller, and urges the intermediate transfer belt 36 in a tensioning direction thereof with a biasing means not shown. The driven roller 33 is a back-up roller for forming a secondary transfer portion T2. A secondary transfer roller 38 is disposed opposite to this back-up roller 33 with the interposition of the intermediate transfer belt 36. Secondary transfer voltage is applied to the secondary transfer roller, which is constituted so that the clearance between the secondary transfer roller and the intermediate transfer belt 36 is adjustable with a clearance adjusting mechanism not shown. The driven roller 34 is a back-up roller for a belt cleaner 39. The belt cleaner 39 is constituted so that the clearance between the belt cleaner and the intermediate transfer belt 36 is adjustable with a clearance adjusting mechanism not shown.

The intermediate transfer belt 36 comprises a multilayer belt having a conductive layer and a resistive layer formed thereon and brought into press contact with the photoreceptor 140. The conductive layer is formed on an insulating substrate formed of a synthetic resin, and the primary transfer voltage is applied to this conductive layer through the above-mentioned electrode roller. The resistive layer is removed in strip form along a side edge of the belt, thereby exposing the conductive layer in strip form. The electrode roller is arranged so as to come in contact with the exposed portion.

In the course in which the intermediate transfer belt 36 is driven for circulation, the toner image on the photoreceptor 140 is transferred onto the intermediate transfer belt 36 at the primary transfer portion T1, and the toner image transferred onto the intermediate transfer belt 36 is transferred to a recording medium S such as paper which is supplied between the intermediate transfer belt and the secondary transfer roller 38 at the secondary transfer portion T2. The sheet S is fed from a sheet paper feeder 50, and supplied to the secondary transfer portion T2 with a pair of gate rollers G at a predetermined timing. The reference numeral 51 designates a paper feed cassette, and the reference numeral 52 designates a pickup roller.

The toner image is fixed at the secondary transfer portion T2, and the sheet is discharged through a delivery path 70 onto a sheet receiving portion 81 formed on a casing 80 of a main body of the apparatus. This image forming apparatus has two delivery paths 71 and 72 which are independent from each other, as the delivery path 70, and the sheet which has passed through a fixing device 60 is discharged through either the delivery path 71 or 72. Further, the delivery paths 71 and 72 also form a switchback path. When images are formed on both sides of the sheet, the sheet which has once entered the delivery path 71 or 72 is supplied again to the secondary transfer portion T2 through a return roller 73.

The outline of the operations of the whole image forming apparatus as described above is as follows:

(1) When image information is transmitted from a personal computer or the like (not shown) to a control unit 90 of the image forming apparatus, the photoreceptor 140, the respective rollers 9 of the developing devices 10 and the intermediate transfer belt 36 are driven for rotation.

(2) The outer peripheral surface of the photoreceptor 140 is uniformly charged by the charging roller 160.

(3) The uniformly charged outer peripheral surface of the photoreceptor 140 is selectively exposed to light L1 corresponding to image information of a first color (for example, yellow) with the exposure unit 40, thereby forming an electrostatic latent image for yellow.

(4) Only the developing roller of the developing device 10Y for the first color, for example, yellow, is brought into contact with the photoreceptor 140, thereby developing the above-mentioned electrostatic latent image to form a toner image of the first color, yellow, on the photoreceptor 140.

(5) The primary transfer voltage having a charge polarity opposite to that of the above-mentioned toner is applied to the intermediate transfer belt 36, and the toner image formed on the photoreceptor 140 is transferred onto the intermediate transfer belt 36 at the primary transfer portion T1. At this time, the secondary transfer roller 38 and the belt cleaner 39 are kept away from the intermediate transfer belt 36.

(6) After the toner remaining on the photoreceptor 140 has been removed with a cleaning means 170, the charge of the photoreceptor 140 is removed by charge removing light L2 from a removing means 41.

(7) The above-mentioned operations (1) to (6) are repeated as needed. That is to say, according to print command signals, the operations are repeated for a second, third and fourth colors, and toner images corresponding to the above-mentioned print command signals are superposed on each other on the intermediate transfer belt 36 to form a full color image.

(9) The sheet S is fed from a sheet paper feeder 50 at a predetermined timing, and the toner image on the intermediate transfer belt 36, that is to say, the full color image formed by superimposing the four color toner images, is transferred onto the sheet S with the secondary transfer roller 38, immediately before or after an end of the sheet S has reached the secondary transfer portion T2, namely, at the timing when the toner image on the intermediate transfer belt 36 is transferred to a desired position on the sheet S. Further, the belt cleaner 39 is brought into abutting contact with the intermediate transfer belt 36 to remove the toner remaining on the intermediate transfer belt 36 after the secondary transfer.

(9) The sheet S passes through the fixing device 60, thereby fixing the toner image on the sheet S. Then, the sheet S is conveyed toward a predetermined position (toward the sheet receiving portion 81 in the case of no double-sided printing, or toward the return roller 73 through the switch-back path 71 or 72 in the case of double-sided printing).

In the image forming apparatus according to the present invention, the developing roller 9 and the intermediate transfer medium 36 may be in abutting contact with the photoreceptor 140, and development may be conducted by the non-contact process.

Figure 4:
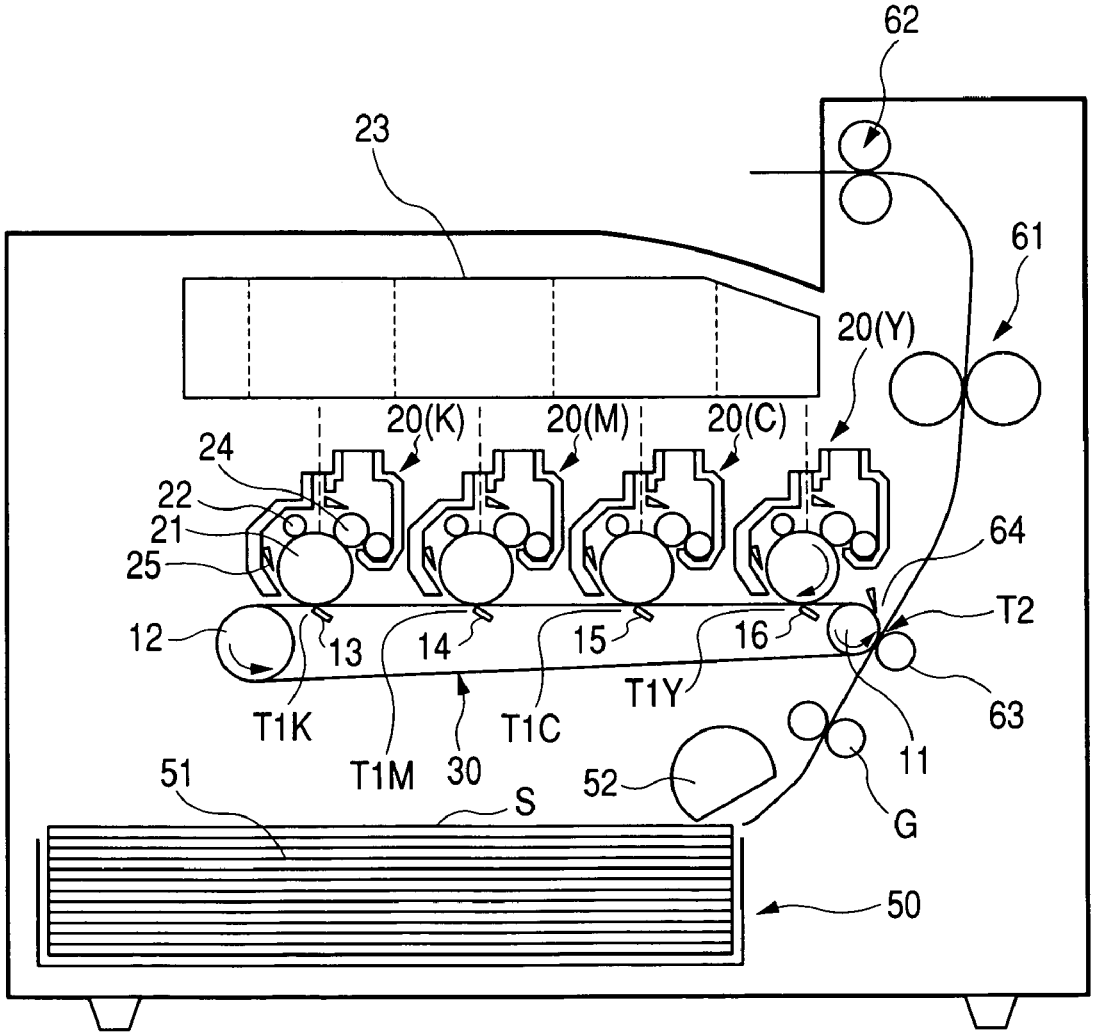
FIG. 4 is a schematic front view illustrating an embodiment of a full color printer of a tandem system using a toner of the present invention.

Similarly, a schematic front view of a full color printer of a tandem system used in the present is shown in FIG. 4. In this case, the photoreceptor and the developing unit are constituted so as to be mounted as one unit, that is to say, a process cartridge which can be detachably mounted on a main body of the image forming apparatus. As for development, an example of the contact process is shown, but the non-contact process can also be employed.

This image forming apparatus comprises an intermediate transfer belt 30 laid around only two rollers, namely, a driving roller 11 and a driven roller 12, under tension, and driven for circulation in the direction indicated by the arrow in FIG. 4 (counterclockwise), and four monochromatic toner image forming units 20(Y), 20(C), 20(M) and 20(K) arranged along the intermediate transfer belt 30. The image forming apparatus is constituted so that toner images formed with the plurality of monochromatic toner image forming units 20 are sequentially primarily transferred to the intermediate transfer belt 30 with individual transfer means 13, 14, 15 and 16. The respective primary transfer portions are indicated by T1Y, T1C, T1M and T1K.

AS the monochromatic toner image forming units, there are arranged the unit 20(Y) for yellow, the unit 20(M) for magenta, the unit 20(C) for cyan and the unit 20(K) for black. These monochromatic toner image forming units 20(Y), 20(C), 20(M) and 20(K) each comprises a photoreceptor 21 having a photosensitive layer on its outer peripheral surface, a charging roller 22 as a charging mean for uniformly charging the outer peripheral surface of the photoreceptor 21, an exposure unit 23 for selectively exposing the outer peripheral surface uniformly charged with the charging roller 22 to form an electrostatic latent image, a developing roller 24 as a developing means for imparting a developing agent or a toner to the electrostatic latent image formed with the exposure unit 23 to form a visible image (toner image), and a cleaning blade 25 as a cleaning means for removing the toner remaining on the surface of the photoreceptor 21 after the toner image developed with the developing roller 24 has been transferred to the intermediate transfer belt 30 for primary transfer.

These monochromatic toner image forming units 20(Y), 20(C), 20(M) and 20(K) are arranged on a loose side of the intermediate transfer belt 30. The toner images are sequentially primarily transferred to the intermediate transfer belt 30, and sequentially superposed on each other on the intermediate transfer belt 30 to form a full color toner image. The full color toner image is secondarily transferred to a recording medium S such as a paper sheet at a secondary transfer portion T2, and fixed onto the recording medium S by passing between a pair of fixing rollers 61. Then, the recording medium S is discharged with a pair of delivery rollers 62 to a predetermined place, that is to say, a delivery tray or the like (not shown). The reference numeral 51 designates a paper feed cassette in which the recording media S are held in the stacked state, 52 designates a pickup roller for feeding the recording media S sheet by sheet from the paper feed cassette 51, and G designates a pair of gate rollers for defining a paper feed timing of the recording medium S to the secondary transfer portion T2.

Further, the reference numeral 63 designates a secondary transfer roller as a secondary transfer means for forming the secondary transfer portion T2 between the secondary transfer roller and the intermediate transfer belt 30, and 64 designates a cleaning blade as a cleaning means for removing the toner remaining on a surface of the intermediate transfer belt 30 after secondary transfer. The cleaning blade 64 after secondary transfer is in abutting contact with the intermediate transfer belt 30 at a portion at which the intermediate transfer belt 30 is wrapped around the driving roller 11, not around the driven roller 12.

EXAMPLES

The present invention is now illustrated in greater detail with reference to Examples and Comparative Examples, but it should be understood that the present invention is not to be construed as being limited thereto.

Methods for preparing toner mother particles used in Examples described later and the like will be shown below.

Preparation of Toner Mother Particles 1

A monomer mixture of 80 parts by weight of a styrene monomer, 20 parts by weight of butyl acrylate and 5 parts by weight of acrylic acid was added to an aqueous mixture of 105 parts by weight of water, 1 part by weight of a nonionic emulsifier, 1.5 parts by weight of an anionic emulsifier and 0.55 part by weight of potassium persulfate.

Then, polymerization was conducted with stirring at 70° C. in a stream of nitrogen for 8 hours. The reaction product was cooled after the polymerization reaction to obtain a milky white resin emulsion having a particle size of 0.25 μm.

Then, a mixture of 200 parts by weight of the resulting resin emulsion, 20 parts by weight of a polyethylene wax emulsion (manufactured by Sanyo Chemical Industries, Ltd., Permarin PN) and 7 parts by weight of Phthalocyanine Blue was dispersed in water containing 0.2 part by weight of sodium dodecylbenzenesulfonate, and diethylamine was added to adjust the pH to 5.5. Thereafter, 0.3 part by weight of aluminum sulfate was added thereto with stirring, and then, dispersed by high-speed stirring using an emulsifying and dispersing apparatus (manufactured by Tokushu Kika Kogyo Co., Ltd., TK Homomixer).

Further, 40 parts by weight of styrene monomer, 10 parts by weight of butyl acrylate, 5 parts by weight of zinc salicylate were added together with 40 parts by weight of water, and similarly heated at 90° C. with stirring in a stream of nitrogen. Then, hydrogen peroxide was added and polymerization was conducted for 5 hours to allow particles to grow. After the polymerization was terminated, the temperature was elevated to 95° C. while adjusting the pH to 5 or more, and maintained for 5 hours, for increasing the bond strength of associated particles. Thereafter, the resulting particles were washed with water, and dried under vacuum at 45° C. for 10 hours.

The resulting cyan toner was a toner having a number-based mean particle size of 6.8 μm and a sphericity of 0.980. The work function of the resulting toner mother particles 1 was measured. As a result, it was 5.57 eV.

Preparation of Toner Mother Particles 2

A magenta toner was obtained in the same manner as with the preparation of toner mother particles 1 with the exception that quinacridone was used in place of Phthalocyanine Blue, and that in order to enhance the association of secondary particles and the film-forming bond strength thereof, the temperature was kept at 90° C. without elevation to 95° C. The resulting magenta toner was a toner having a number-based mean particle size of 7.0 μm and a sphericity of 0.976. The work function of the resulting toner mother particles 2 was measured. As a result, it was 5.64 eV.

Preparation of Toner Mother Particles 3 and 4

Polymerization was conducted in the same manner as with the preparation of toner mother particles 2 with the exception that Pigment Yellow 180 and carbon black were each used in place of Phthalocyanine Blue in the preparation of toner mother particles 1, thereby obtaining a yellow toner and a black toner, respectively.

The resulting yellow toner was a toner having a number-based mean particle size of 6.9 μm and a sphericity of 0.973. The work function of the resulting toner mother particles 3 was measured. As a result, it was 5.59 eV.

Further, the resulting black toner was a toner having a number-based mean particle size of 7.0 μm and a sphericity of 0.974. The work function of the resulting toner mother particles 4 was measured similarly. As a result, it was 5.52 eV.

Preparation of Toner Mother Particles 5

A hundred parts by weight of a 50:50 (by weight) mixture (manufactured by Sanyo Chemical Industries, Ltd., Himer ES-803) of a polycondensation polyester of an aromatic dicarboxylic acid and alkylene etherified bisphenol A, and a partially crosslinked product of the polycondensation polyester with a multivalent metal compound, 5 parts by weight of Pigment Blue 15:1, a cyan pigment, 3 parts by weight of polypropylene (melting point: 152° C., weight average molecular weight: 4,000) as a release agent and 4 parts by weight of a metal complex of salicylic acid (manufactured by Orient Chemical Industries, Ltd., E-81) as a charge control agent were homogeneously mixed using a Henschel mixer, then kneaded by a twin-screw extruder having an internal temperature of 140° C., and cooled. The cooled product was pulverized to crude particles of 2 mm square, which was further finely pulverized with a jet mill. The resulting fine particles were classified with a classifying apparatus by rotor rotation to obtain a classified toner having a number-based mean particle size of 6.2 μm and a sphericity of 0.905.

Hydrophobic silica (mean primary particle size: 7 nm, specific surface area: 250 $m^2/g$) was added to the classified toner at a weight ratio of 0.2% to conduct surface treatment. Then, using a hot air spheroidizing apparatus "Therfusion System", the heat treatment temperature was set to 250° C., and partial spheroidizing treatment was conducted. Thereafter, the resulting toner particles were classified again with a classifying apparatus by rotor rotation to obtain a cyan toner having a number-based mean particle size of 6.3 μm and a sphericity of 0.943. The work function of the resulting toner mother particles 5 was measured similarly. As a result, it showed 5.46 eV.

Preparation of Toner Mother Particles 6, 7 and 8

Pulverization, classification, surface treatment by heat treatment and reclassification were conducted in the same manner as with the preparation of toner mother particles 5 with the exception that the pigment was substituted by 6B of the Naphthol AS series to obtain a magenta toner having a number-based mean particle size of 6.6 μm and a sphericity of 0.943. The work function of the resulting toner mother particles 6 was measured similarly. As a result, it showed 5.53 eV.

Similarly, toner mother particles 7 (Pigment Yellow 93 was used as a yellow toner) and toner mother particles 8 (carbon black was used as a black toner) were each prepared. The mean particle size and the sphericity of the resulting toner mother particles showed values similar to those of toner mother particles 6. Further, the work function of toner mother particles 7 was 5.57, and the work function of toner mother particles 8 was 5.63.

Preparation of Developing Roller

Nickel plating having a thickness of 10 μm was applied onto a surface of an aluminum pipe having an outer diameter of 18 mm. The surface roughness (Ra) of the plated layer was 4 μm. The surface of the resulting developing roller was partially cut, and the work function thereof was measured in the same manner as with an organic photoreceptor. As a result, it was 4.58 eV.

Preparation of Regulating Blade

A conductive urethane rubber piece having a thickness of 1.5 mm was adhered to a SUS plate having a thickness of 80 μm with a conductive adhesive to produce a regulating blade. The work function of the polyurethane rubber portion was measured in the same manner as with an organic photoreceptor. As a result, it was about 5 eV.

Preparation of Transfer Belt 1

A homogeneous liquid dispersion of 30 parts by weight of a vinyl chloride-vinyl acetate copolymer, 10 parts by weight of conductive carbon black and 70 parts by weight of methanol was applied onto a 130 μm-thick, aluminum-deposited polyethylene terephthalate film by roll coating so that the coated film after drying has a thickness of 20 μm, and dried to prepare an intermediate conductive layer.

Then, a liquid dispersion obtained by mixing and dispersing 55 parts by weight of a nonionic aqueous urethane resin (solid content: 62%), 11.6 parts by weight of a polytetrafluoroethylene emulsion (solid content: 60%), 25 parts by weight of conductive tin oxide, 34 parts by weight of fine polytetrafluoroethylene particles (maximum particle size: 0.3 μm or less), 5 parts by weight of a polyethylene emulsion (solid content: 35%) and 20 parts by weight of ion exchanged water was applied onto the intermediate conductive layer by roll coating so as to give a thickness of 10 μm after drying, and dried. A film in which the coated film was formed was cut to a length of 540 mm. Both ends were overlapped with each other and welded by ultrasonic welding, thereby preparing a transfer belt. The volume resistance of this transfer belt was $2.5\times10^{10}$ Ω·cm. Further, the work function showed 5.37 eV, and the normalized photoelectron yield showed 6.90.

Production Example of Organic Photoreceptor (OPC1)

A coating solution obtained by dissolving and dispersing 6 parts by weight of an alcohol-soluble nylon resin (manufactured by Toray Industries, Inc., CM8000) and 4 parts by weight of fine aminosilane-treated titanium oxide particles in 100 parts by weight of methanol was applied onto a conductive support of an aluminum pipe having a diameter of 85.5 mm by ring coating, and dried at a temperature of 100 ° C. for 40 minutes to form an undercoat layer having a thickness of 1.5 to 2 μm.

A liquid dispersion obtained by dispersing 1 part by weight of oxytitanium phthalocyanine as a charge generating agent and 1 part by weight of a butyral resin (manufactured by Sekisui Chemical Co., Ltd., BX-1) in 100 parts by weight of dichloroethane for 8 hours in a sand mill using glass beads having a diameter of 1 mm was applied onto this undercoat layer by ring coating, and dried at 80° C. for 20 minutes to form a charge generating layer having a thickness of 0.3 μm.

Onto the charge generating layer, a solution obtained by dissolving 40 parts by weight of a charge transporting material of a styryl compound represented by the following formula (I) and 60 parts by weight of a polycarbonate resin (manufactured by Teijin Chemicals Ltd., Panlite TS) in 400 parts by weight of toluene was applied by dip coating so as to give a dry thickness of 22 μm, and dried to form a charge transporting layer, thus preparing an organic photoreceptor (1) having a photosensitive layer comprising two layers of the charge generating layer and the charge transporting layer.

(I)

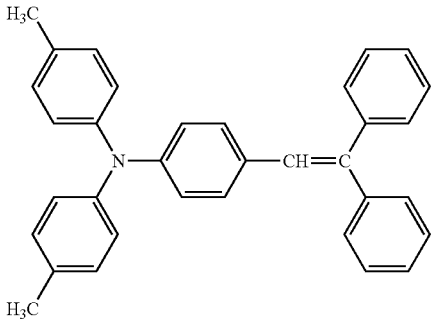

The resulting organic photoreceptor (1) was partially cut to form a test piece, and the work function thereof was measured using a surface analyzer (manufactured by Riken Keiki Co., Ltd., AC-2) at a dose of irradiating light of 500 nW. As a result, it showed 5.48 eV.

Production Example of Organic Photoreceptor (OPC2)

An organic photoreceptor (OPC2) was prepared in the same manner as with the production example of organic photoreceptor (OPC1) with the exception that a seamless nickel electroformed pipe having a thickness of 40 μm and a diameter of 85.5 mm was used as the conductive support, and that the charge transporting material was changed to a distyryl compound of the following formula (II). The work function of this organic photoreceptor was measured similarly. As a result, it was 5.50 eV.

(II)

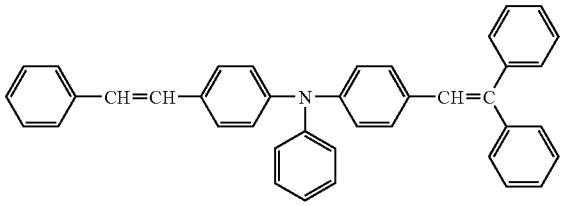

Production Example of Organic Photoreceptor (OPC3)

An organic photoreceptor was prepared in the same manner as with the production example of organic photoreceptor (OPC1) with the exception that an aluminum pipe having a diameter of 30 mm was used as the conductive support. The work function of the resulting organic photoreceptor was measured similarly. As a result, it was 5.48 eV.

Preparation of Surface-Modified Silica Particles

A hundred grams of silica particles (specific surface area: 130 $m^2/g$) produced by a vapor-phase process were dispersed in 2000 ml of water, and the resulting liquid dispersion was heated to 70° C. Then, 250 ml of an aqueous solution of titanium sulfate having a concentration of 100 g/l as $TiO_2$ and a 5 N aqueous solution of sodium hydroxide were concurrently added dropwise so as to give a pH of 6.0. After the termination of dropping, the solution was cooled to 40° C., and the pH was adjusted to 4.0. Subsequently, 25 g of n-hexyltrimethoxysilane was added. After the solution was kept with stirring for 4 hours, a 2 N aqueous solution of sodium hydroxide was added to adjust the pH to 6.5, and the solution was further kept with stirring for 2 hours. Then, after filtration and water washing, the resulting filtered product was dried, and finely pulverized with a pulverizing mill to obtain silica particles surface modified with an oxide. The resulting particles have a specific surface area of 88.4 $m^2/g$, and a degree of hydrophobicity of 62.5%.

The degree of hydrophobicity was measured by the following method. Aqueous methanol solutions different in methanol concentration were prepared, and 10 ml of each aqueous methanol solution was poured into a 25-ml test tube with a ground-in stopper. Then, 10 mg of a sample to be measured was put therein, and the methanol concentration (% by weight) at which sedimentation started was visually determined. The methanol concentration thus determined was indicated as the degree of hydrophobicity.

Further, the surface-modified silica particles had a mean primary particle size of about 18 nm. The work function thereof was measured similarly. As a result, it was 5.38 eV.

Production of Combined Oxide Particles

Figure 5:
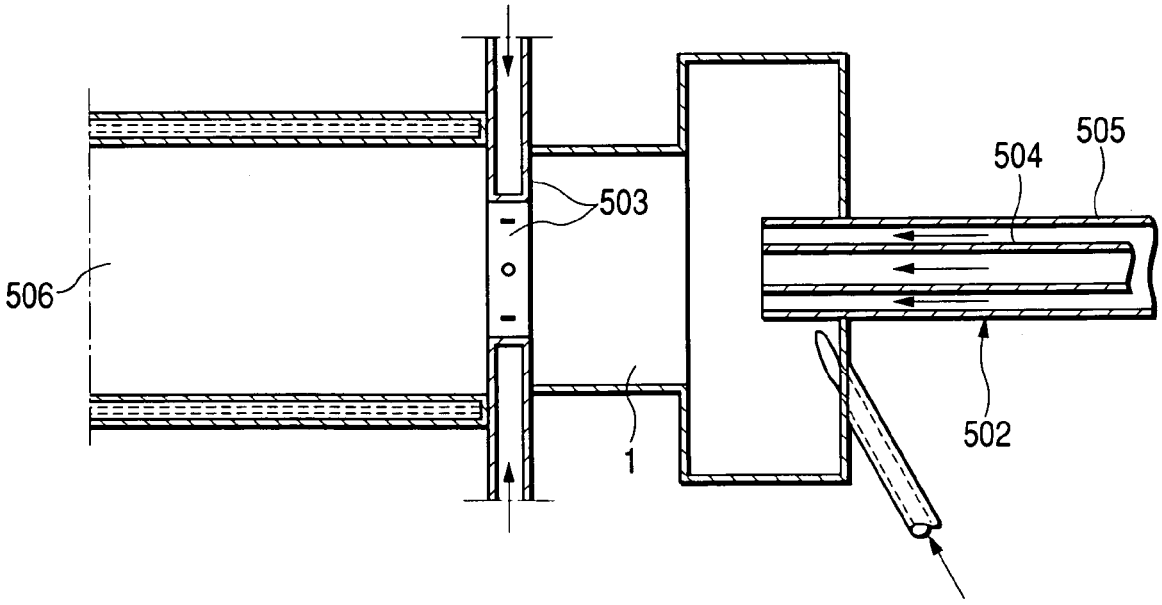
FIG. 5 is a view showing a burner apparatus for producing combined oxide particles in the present invention.

FIG. 5 shows a burner apparatus for producing combined oxide particles. Referring to FIG. 5, the reference numeral 501 designates a combustion chamber, 502 designates a double-jacketed tube, 503 designates an annular diaphragm, 504 designates an inner tube, 505 designates an outer tube, and 506 designates a water-cooled flame tube. The double-jacketed tube 502 projects in the combustion chamber 501, and a hot mixed vapor of 200° C. obtained by mixing 1.4 $Nm^3/h$ of hydrogen, 5.5 $Nm^3/h$ of air and 1.30 kg/h of previously evaporated gaseous $SiCl_4$ is introduced from the inner tube 504 of the double-jacketed tube 502. Then, gaseous $AlCl_3$ previously evaporated at 300° C. is additionally supplied to this hot mixed vapor at a rate of 2.34 kg/h, and introduced into the flame tube. At the same time, 12 $Nm^3/h$ of air is additionally supplied to allow the vapor to burn. In this case, air is introduced into the combustion chamber, and air is additionally introduced from the annular diaphragm 503. In the flame, water produced and a chloride are allowed to rapidly react with each other to form combined oxide particles. After having passed through the flame tube, a powder produced is separated using a filter or a cyclone, and a hydrochloric acid component adhered to the powder is removed. The resulting combined oxide particles comprise 65% by weight of $Al_2O_3$ and 35% by weight of $SiO_2$, and have a mean primary particle size of 14 nm, a specific surface area by the BET method of 74 $m^2/g$ and a volume resistance of $10^{12}$ Ω·cm. The resulting combined oxide particles were subjected to hydrophobic treatment with dimethylsilane (DMS). The work function of the resulting combined oxide particles was measured similarly. As a result, the combined oxide particles showed two kinds of work functions, 5.18 eV and 5.61 eV.

Experimental Example 1

Hydrophobic fine silica particles (specific surface area by the BET method: 300 $m^2/g$, mean primary particle size: 7 nm) treated with hexamethyldisilazane was added to and mixed with toner mother particles 2 obtained above in an amount of 0.1% by weight, and then, external additives shown in Table 1 described below were each added to the resulting fine silica particle-coated toner in an amount of 0.2% by weight to prepare five kinds of magenta toners 2-1 to 2-5, respectively.

Measurement of the Rate of Liberation of Various External Additives from Toner Mother Particles The rate of liberation of the various external additives shown in Table 1 described below was determined using a particle analyzer (manufactured by Yokogawa Electric Corporation, PT1000). The results thereof are shown in Table 2. The rate of liberation as used herein is calculated from the number of elements detected by the measurement with the particle analyzer, and defined by the following equation:

Number rate of liberation=(detected number of librated additive/all detected number of additive)×100

TABLE 1

| Toner No. | External Additive | Specific Surface Area by BET Method ($m^2/g$) | Mean Primary Particle Size (nm) |
|---|---|---|---|
| 2-1 | Hydrophobic silica[1)] | ca. 300 | ca. 7 |
| 2-2 | Hydrophilic alumina | ca. 100 | ca. 13 |
| 2-3 | Hydrophobic titanium oxide[2)] (titania) | 135 | ca. 20 |
| 2-4 | Combined oxide particles[3)] | 100-110 | ca. 17 |
| 2-5 | Surface-modified silica particles[4)] | 88.4 | ca. 18 |

As for the external additives (hydrophobilizing agents) in Table 1, 1) is hexamethylenedisilazane, 2) is n-butyltrimethoxysilane, 3) is dimethylsilane, and 4) is n-hexyltrimethoxysilane. The combined oxide particles of 3) and the surface-modified silica particles of 4) are ones prepared above.

TABLE 2

| | Number Rate of Liberation (%) | | |
|---|---|---|---|
| Toner No. | Si | Al | Ti |
| 2-1 | 0.63 | — | — |
| 2-2 | 0.21 | 0.07 | — |
| 2-3 | 0.25 | — | 1.02 |
| 2-4 | 0.20 | 0.07 | — |
| 2-5 | 0.13 | — | 0.12 |

As apparent from Tables 1 and 2, in the number rate of liberation of the external additives from the toner mother particles, it is found that the toner (2-4) containing the combined oxide particles can restrain the rate of Si liberation to a low level, compared to the toner (2-1) containing the fine silica particles. Compared to the toner (2-2) containing alumina, the toner (2-4) has a rate of Si liberation equivalent to or less than that of the toner (2-2) and a rate of Al liberation equivalent to that of the toner (2-2). Further, a comparison between the toner (2-3) containing titania and the toner (2-5) containing the silica particles surface modified with titania reveals that the latter is lower in both the rate of Si liberation and the rate of Ti liberation of the external additive, which shows that the surface-modified silica particles strongly adhere to the toner mother particles.

Image Formation Test and Measurement of Charge Characteristics

Hexamethyldisilazane-treated hydrophobic fine silica particles S (mean primary particle size: about 7 nm) and hexamethyldisilazane-treated hydrophobic fine silica particles L (mean primary particle size: about 40 nm) were added to and mixed with the toner mother particles 1 obtained above, at addition ratios shown in Table 3. Then, additives other than silica described in Table 3 were added to and mixed with the resulting fine silica particle-coated toners at addition ratios (per toner mother particles, % by weight) described in Table 3 to prepare seven kinds of cyan toners 1-1 to 1-7. The results of an image formation test using each cyan toner and the results of charge characteristics are shown in Tables 4 and 5.

The image formation test was carried out using the 4-cycle color printer shown in FIG. 3 which was equipped with organic photoreceptor (OPC1), the developing rollers, the regulating blades and transfer belt 1 described above. The peripheral speed of the organic photoreceptor was set to 180 mm/s, the ratio of the peripheral speed of the developing rollers to that of the photoreceptor was set to 1.3, and the difference in peripheral speed between the organic photoreceptor and the intermediate transfer belt was set so that the transfer belt becomes 3% faster than the organic photoreceptor. In a preliminary test, it was confirmed that exceeding 3% resulted in the occurrence of dust on a transferred image. Accordingly, the upper limit was set to 3%. The regulating conditions of the above-mentioned toner regulating blade were adjusted so that the amount of the toner transferred onto the developing roller reached 0.38 $mg/cm^2$. Each of the toners 1-1 to 1-7 was set in the cyan developing device, and the image formation was conducted by the non-contact developing process (dark potential: −600 V, light potential: −80 V, DC developing bias: −200 V, AC bias: 1.4 kV, AC frequency: 2.5 kHz) in which the developing gap was set to 210 μm. The image formation was conducted on two sheet of a solid print and a 5% manuscript.

As for the charge characteristics, the charge characteristics of the toner on the developing roller was measured with a charge distribution measuring device (E-SPART Analyzer Type EST-3) manufactured by Hosokawa Micron Corporation, and the results thereof are shown in Table 4. Further, the solid image density (solid OD Value) in the image formation, the fog density (fog OD Value) on the organic photoreceptor and the OD value of the reverse transfer toner transferred onto the photoreceptor are shown in FIG. 5.

The solid OD value was determined by printing a solid image, and measuring the density of the image after fixing with a reflection densitometer (manufactured by a X-Rite, Inc., X-Rite 404).

Further, the fog density of a non-image area on the organic photoreceptor (fog OD Value) was determined by a tape transfer method. In addition, the density of the so-called "reverse transfer toner" (Reverse Transfer Toner OD Value) which returned onto the organic photoreceptor after the formation of the solid image was similarly determined by the tape transfer method.

The tape transfer method is a technique comprising attaching an adhesive tape (manufactured by Sumitomo 3M Ltd., Mending Tape 801-1-18) to the toner on the organic photoreceptor, subsequently attaching the tape onto a white paper, measuring the density from above the tape with a reflection densitometer (manufactured by a X-Rite, Inc., X-Rite 404), and subtracting the density of an area to which no toner was transferred and only the tape was attached, from this measured value, thereby determining the reflection density value.

TABLE 3

| Toner No. | Combination of Additives | Compounding Ratio (% by weight) |
|---|---|---|
| 1-1 | Silica S/Silica L/alumina/titania/StMg | S0.5/L0.3/0.2/0.5/0.2 |
| 1-2 | Silica S/Silica L/AlSi/TiSi/StMg | S0.4/L0.3/0/0.5/0.2 |
| 1-3 | Silica S/Silica L/AlSi/TiSi/StMg | S0.4/L0.3/0.01/0.2/0.2 |
| 1-4 | Silica S/Silica L/AlSi/TiSi/StMg | S0.4/L0.3/0.05/0.1/0.2 |
| 1-5 | Silica S/Silica L/AlSi/TiSi/StMg | S0.4/L0.3/0.1/0.05/0.2 |
| 1-6 | Silica S/Silica L/AlSi/TiSi/StMg | S0.4/L0.3/0.2/0.01/0.2 |
| 1-7 | Silica S/Silica L/AlSi/TiSi/StMg | S0.5/L0.3/0.5/0/0.2 |

In Table 3, toner 1-1 indicates to add hydrophilic silica (S) having a mean primary particle size of 7 nm and hydrophilic silica (L) having a mean primary particle size of 40 nm in amounts of 0.5% by weight and 0.3% by weight, respectively, based on the toner mother particles, and then, to add alumina described in Table 1, titania described in Table 1 and magnesium stearate (StMg, manufactured by Kanto Kagaku, work function: 5.57 eV) were in amounts of 0.2% by weight, 0.5% by weight and 0.2% by weight, respectively, based on the toner mother particles. The same is equally true for the toners 1-2 to 1-7.

TABLE 4

| Toner No. | Average Amount of Charge (μc/g) | Amount of Positively Charged Toner (number %) |
|---|---|---|
| 1-1 | −15.14 | 5.7 |
| 1-2 | −19.37 | 3.1 |
| 1-3 | −17.53 | 2.9 |
| 1-4 | −16.66 | 2.1 |
| 1-5 | −16.11 | 1.3 |
| 1-6 | −18.71 | 1.5 |
| 1-7 | −20.33 | 4.1 |

TABLE 5

| Toner No. | Solid OD Value | Fog OD Value | Reverse Transfer Toner OD Value |
|---|---|---|---|
| 1-1 | 1.37 | 0.04 | 0.01 |
| 1-2 | 1.25 | 0.01 or less | 0.01 or less |
| 1-3 | 1.30 | 0.01 or less | 0.01 or less |
| 1-4 | 1.32 | 0.01 or less | 0.01 or less |
| 1-5 | 1.34 | 0.01 or less | 0.01 or less |
| 1-6 | 1.27 | 0.01 or less | 0.01 or less |
| 1-7 | 1.22 | 0.03 | 0.01 |

The results shown in Tables 4 and 5 reveal that the toners (1-3 to 1-6) of the present invention make it possible to obtain desired charge characteristics and to improve image qualities (the prevention of fogging and the reverse transfer toner, and ensuring of image density), even when they are used in smaller amounts than the toner (1-1). The amount of the toner used equivalent to or less than the conventional amount used can provide the equivalent or higher effect, which causes a decrease in the amount of external additives used, resulting in improved fixability. Toner 1-2 shows that no addition of combined oxide particles results in a reduction in image density, and toner 1-7 shows that no addition of surface-modified silica particles poses a problem with respect to the prevention of fogging and the reverse transfer toner, and ensuring of image density.

Experimental Example 2

Hydrophobic fine silica particles S (mean primary particle size: 12 nm) treated with hexamethylsilazane and hydrophobic fine silica particles L (mean primary particle size: 40 nm) similarly subjected to hydrophobic treatment was added to and mixed with toner mother particles 5 prepared above in amounts of 0.5% by weight and 0.5% by weight, respectively. Then, additives other than silica shown in Table 6 were added to and mixed with the resulting fine silica particle-coated toners at addition ratios (% by weight) described in Table 6 to prepare seven kinds of cyan toners 5-1 to 5-7. The evaluation results of image characteristics by an image formation test using each cyan toner are shown in Tables 7 and 8.

TABLE 6

| Toner No. | Combination of Additives | Compounding Ratio (% by weight) |
|---|---|---|
| 5-1 | Silica S/Silica L/alumina/titania/StCa | S0.5/L0.5/0.2/0.5/0.2 |
| 5-2 | Silica S/Silica L/AlSi/TiSi/StCa | S0.4/L0.5/0/0.5/0.2 |
| 5-3 | Silica S/Silica L/AlSi/TiSi/StCa | S0.4/L0.5/0.01/0.2/0.2 |
| 5-4 | Silica S/Silica L/AlSi/TiSi/StCa | S0.4/L0.5/0.05/0.1/0.2 |
| 5-5 | Silica S/Silica L/AlSi/TiSi/StCa | S0.4/L0.5/0.1/0.05/0.2 |
| 5-6 | Silica S/Silica L/AlSi/TiSi/StCa | S0.4/L0.5/0.2/0.01/0.2 |
| 5-7 | Silica S/Silica L/AlSi/TiSi/StCa | S0.5/L0.5/0.5/0/0.2 |

The meaning in Table 6 is the same as defined in Table 3, and StCa is calcium stearate (manufactured by Kanto Kagaku, work function: 5.49 eV).

TABLE 7

| Toner No. | Average Amount of Charge (μc/g) | Amount of Positively Charged Toner (number %) |
|---|---|---|
| 5-1 | −14.92 | 7.3 |
| 5-2 | −18.59 | 3.4 |
| 5-3 | −17.18 | 3.3 |
| 5-4 | −16.09 | 3.0 |
| 5-5 | −15.81 | 2.8 |
| 5-6 | −19.01 | 2.2 |
| 5-7 | −21.10 | 5.9 |

TABLE 8

| Toner No. | Solid OD Value | Fog OD Value | Reverse Transfer Toner OD Value |
|---|---|---|---|
| 5-1 | 1.37 | 0.04 | 0.01 |
| 5-2 | 1.25 | 0.01 or less | 0.01 or less |
| 5-3 | 1.30 | 0.01 or less | 0.01 or less |
| 5-4 | 1.32 | 0.01 or less | 0.01 or less |
| 5-5 | 1.34 | 0.01 or less | 0.01 or less |
| 5-6 | 1.27 | 0.01 or less | 0.01 or less |
| 5-7 | 1.22 | 0.03 | 0.01 |

The results shown in Tables 7 and 8 reveal that the toners (5-3 to 5-6) of the present invention make it possible to obtain desired charge characteristics and to improve image qualities (the prevention of fogging and the reverse transfer toner, and ensuring of image density), even when they are used in smaller amounts than the toner (5-1). The amount of the toner used equivalent to or less than the conventional amount used can provide the equivalent or higher effect, which causes a decrease in the amount of external additives used, resulting in improved fixability.

Experimental Example 3

The external additives were added to and mixed with toner mother particles 2, toner mother particles 3 and toner mother particles 4 in the same manner as with cyan toner 1-5 of Experimental Example 1 to prepare a magenta toner, a yellow toner and a black toner, respectively.

Then, using a 4-cycle color printer of an intermediate transfer medium process shown in FIG. 3 in which an elastic photoreceptor of organic photoreceptor (OPC2) was used and which was equipped with the developing rollers, the regulating blades and intermediate transfer belt 1, each developing unit was filled with each toner obtained above, and an image formation test was carried out by a contact single-component developing process. As for the setting order of the developing devices, a first developing device filled with the magenta toner, a second developing device filled with the yellow toner, a third developing device filled with the cyan toner and a fourth developing device filled with the black toner were arranged in this order from the upstream.

In the image formation, the peripheral speed of the organic photoreceptor is set to 180 mm/s, the ratio of the peripheral speed of the developing rollers to that of the photoreceptor is set to 2, and the difference in peripheral speed between the organic photoreceptor and the intermediate transfer belt is set so that the transfer belt becomes 3% faster than the organic photoreceptor. As for image formation conditions, the dark potential of the photoreceptor was set to −600 V, the light potential was set to −60 V, the developing bias was set to −200 V, and the developing rollers and supply rollers were set to the same potential. Then, a constant voltage power supply was used as a high voltage power supply of a primary transfer portion, and the transfer voltage was set to +450 V. A constant current power supply was used as a high voltage power supply of a secondary transfer portion, and the transfer current was controlled to 16 μA. Under these conditions, a character manuscript of an A-4 size corresponding a 5% color manuscript for each color was continuously printed on 10,000 sheets of paper, and the states on the photoreceptor and around the drum were checked. As a result, the occurrence of fogging and the reverse transfer toner was scarcely observed, and no scattering of the toner was observed, which showed stable toner charge characteristics. Then, when the amount of the toners collected by cleaning the photoreceptor and the intermediate transfer belt was measured, it was about 10 g, which corresponds to about 1/30 of the expected amount. This was the result of being capable of improving the toner transfer efficiency and inhibiting the occurrence of a fogging toner and the reverse transfer toner to the utmost.

Experimental Example 4

The external addition treatment was conducted to toner mother particles 6, toner mother particles 7 and toner mother particles 8 in the same manner as with cyan toner 5-5 obtained in Experimental Example 2 to obtain a magenta toner, a yellow toner and a black toner, respectively.

Then, each toner was loaded in each color developing cartridge of the full color printer of the tandem system shown in FIG. 4, and the image formation test was carried out by the non-contact single-component developing process. Organic photoreceptor (OPC3) was used as the organic photoreceptor, the developing rollers and the regulating blades were the same as described above, and a belt produced in accordance with the production example of transfer belt 1 was used as the intermediate transfer belt.

As for the setting order of the developing devices, a first developing device filled with the black toner, a second developing device filled with the yellow toner, a third developing device filled with the magenta toner and a fourth developing device filled with the cyan toner were arranged in this order from the upstream.

In the image formation, the AC superimposed on a DC developing bias of −200 V is applied under the conditions of a frequency of 2.5 kHz and a P-P voltage of 1,400 V, and the conditions of a primary transfer portion and a secondary transfer portion are set similarly to Experimental Example 3. Then, a character manuscript of an A-4 size corresponding a 5% color manuscript for each color was continuously printed on 10,000 sheets of paper, and the states on the photoreceptor and around the drum were checked. As a result, the occurrence of fogging and the reverse transfer toner was scarcely observed, and no scattering of the toner was observed, which showed stable toner charge characteristics.

Then, when the amount of the toners collected by cleaning the photoreceptor and the intermediate transfer belt was measured, it was about 23 g, which corresponds to about 1/13 of the expected amount. This was the result of being capable of improving the toner transfer efficiency and inhibiting the occurrence of a fogging toner and the reverse transfer toner to the utmost.

The surface-modified silica particle which is the external additive to the negatively chargeable toner of the present invention has a negative frictional charge site based on the silica component, and a positive frictional charge site. Further, the silica component constituting a base particle easily adheres to the surface of the toner mother particle. It is therefore conceivable that the surface-modified silica particle becomes difficult to liberate from the toner mother particle, compared to the case of addition of the conventional external additive particles such as titania and alumina, which makes it possible to impart stable charge characteristics in continuous printing for a long period of time.

Further, as the external additives, the surface-modified silica particles and the combined oxide particles are added and mixed together with the silica particles different in particle size, thereby being able not only to impart fluidity, but also to stabilize charge, prevent filming and prevent the occurrence of fogging and the reverse transfer toner to give stable full color print quality, even when they are added in remarkably small amounts compared to the amount of the conventional external additive particles such as titania and alumina added. Further, the fixability of the toner is not lowered. In particular, when they are used as the external additives in the toner produced by the polymerization method, the amount thereof used can be decreased compared to the conventional combined system of silica, titania and alumina, and the fixability is not lowered.

Further, regardless of whether the toner is the toner obtained by the pulverization method or the toner produced by the polymerization method, a reduction in toner particle size requires to increase the amount of silica added. As a result, the amount of charge of the toner becomes too large at an early stage, the external additive is embedded or scattered with the progress of printing to decrease the effective surface amount of the external additive, which causes the problem of decreasing the amount of charge of the toner. In addition, the toner consumption tends to increase because of fluctuations in image density and an increase in the amount of fogging. It has been therefore difficult to use as the toner. However, the negatively chargeable toner having the stable amount of charge throughout a printing period can be obtained by adding and mixing the surface-modified silica particles and the combined oxide particles together with the silica particles different in particle size, as the external additives, to the negatively chargeable toner.

While the present invention has been described in detail and with reference to specific embodiments thereof, it will be apparent to one skilled in the art that various changes and modifications can be made therein without departing the spirit and scope thereof.

The present application is based on Japanese Patent Application No. 2003-197599 filed on Jul. 16, 2003, and the contents thereof are incorporated herein by reference.

What is claimed is:

1. A negatively chargeable toner comprising:

resin particles containing a colorant; and an external additive which coats the surface of the resin particles, wherein the external additive comprises;

first silica particles having a number mean primary particle size of 5 to 20 nm and second silica particles having a number mean primary particle size of 30 to 50 nm;

surface-modified silica particles which are surface modified by wet treatment using an oxide or hydroxide of at least one metal selected from the group consisting of titanium, tin, zirconium and aluminum, and are further subjected to hydrophobic treatment; and aluminum oxide-silicon dioxide composite oxide particles obtained by flame hydrolysis and hydrophobic treatment.

2. The negatively chargeable toner according to claim 1, wherein the total amount of the first and second silica particles are 0.5 to 1.5% by weight based on the weight of the resin particles, wherein the weight ratio of the first silica particles to the second silica particles is from 5/1 to 1/5.

3. The negatively chargeable toner according to claim 1, wherein the amount of the surface-modified silica particles is 0.005 to 0.5% by weight based on the weight of the resin particles, wherein the amount of the aluminum oxide-silicon dioxide composite oxide particles is 0.005 to 0.5% by weight based on the weight of the resin particles, wherein the total amount of the surface-modified silica particles and the aluminum oxide-silicon dioxide composite oxide particles is from 0.01 to 1% by weight based on the weight of the resin particles.

4. The negatively chargeable toner according to claim 3, wherein the weight ratio of the surface-modified silica particles to the aluminum oxide-silicon dioxide composite oxide particles is from 2/50 to 50/2.

5. The negatively chargeable toner according to claim 1, wherein the amount of the external additive is 0.51 to 2.5% by weight based on the weight of the resin particles.

6. The negatively chargeable toner according to claim 1, which is produced through a polymerization method.

7. The negatively chargeable toner according to claim 1, wherein the negatively chargeable toner has a sphericity of 0.94 or more.

8. The negatively chargeable toner according to claim 1, wherein the negatively chargeable toner has a number mean particle size of 9 μm or less.

9. A full color toner comprising the negatively chargeable toner according to claim 1.

10. The negatively chargeable toner according to claim 1, wherein the first and second silica particles are subjected to hydrophobic treatment.

11. The negatively chargeable toner according to claim 1, wherein the external additive further comprising a metal soap particle.

12. A process for producing a negatively chargeable toner comprising the steps of:

adding, to resin particles containing a colorant, first silica particles having a number mean primary particle size of 5 to 20 nm and second silica particles having a number mean primary particle size of 30 to 50 nm; and further adding thereto surface-modified silica particles which are surface modified by wet treatment using an oxide or hydroxide of at least one metal selected from the group consisting of titanium, tin, zirconium and aluminum, and are further subjected to hydrophobic treatment, and aluminum oxide-silicon dioxide composite oxide particles obtained by flame hydrolysis and hydrophobic treatment.

13. The process for producing a negatively chargeable toner according to claim 12, wherein the first and second silica particles are subjected to hydrophobic treatment.

14. The process for producing a negatively chargeable toner according to claim 12, further comprising a step of adding a metal soap particle to the resin particles.

15. A full color image forming apparatus comprising: a photoreceptor on which toner images are to be formed; an intermediate transfer medium for transferring the toner images formed on the photoreceptor to a recording medium; and a toner for forming the toner images comprising:

a negatively chargeable toner comprising:

resin particles containing a colorant; and an external additive which coats the surface of the resin particles, wherein the external additive comprises;

first silica particles having a number mean primary particle size of 5 to 20 nm and second silica particles having a number mean primary particle size of 30 to 50 nm;

surface-modified silica particles which are surface modified by wet treatment using an oxide or hydroxide of at least one metal selected from the group consisting of titanium, tin, zirconium and aluminum, and are further subjected to hydrophobic treatment; and aluminum oxide-silicon dioxide composite oxide particles obtained by flame hydrolysis and hydrophobic treatment.

16. The full color image forming apparatus according to claim 15, wherein the photoreceptor is a negatively chargeable organic photoreceptor.

17. The full color image forming apparatus according to claim 15, wherein the intermediate transfer medium is a belt.

18. The full color image forming apparatus according to claim 15, further comprising a image developing device, wherein the photoreceptor and the image developing device are integrated to form a process cartridge, wherein the process cartridge is detachably mounted on the image forming apparatus.

19. The full color image forming apparatus according to claim 15, wherein the ratio of peripheral velocity of the photoreceptor to the intermediate transfer medium is from 0.95 to 1.05.

20. The full color image forming apparatus according to claim 15, wherein the first and second silica particles are subjected to hydrophobic treatment.

21. The full color image forming apparatus according to claim 15, wherein the external additive further comprising a metal soap particle.

22. The full color image forming apparatus according to claim 15, wherein the work function of the negatively chargeable toner is higher than the work function of the surface of the photoreceptor.

* * * * *